US007357982B2

(12) United States Patent
Abe et al.

(10) Patent No.: US 7,357,982 B2
(45) Date of Patent: Apr. 15, 2008

(54) POLYBENZAZOLE FIBER AND USE THEREOF

(75) Inventors: Yukihiro Abe, Otsu (JP); Go Matsuoka, Otsu (JP); Kohei Kiriyama, Otsu (JP); Hiroki Murase, Otsu (JP); Muneatsu Nakamura, Otsu (JP); Yukihiro Nomura, Otsu (JP); Hironori Eguchi, Osaka (JP); Yukinari Okuyama, Osaka (JP); Tadao Kuroki, Osaka (JP); Takaharu Ichiryu, Osaka (JP); Hiroshi Tachimori, Otsu (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 408 days.

(21) Appl. No.: 10/517,832

(22) PCT Filed: Jun. 26, 2003

(86) PCT No.: PCT/JP03/08066

§ 371 (c)(1),
(2), (4) Date: Aug. 12, 2005

(87) PCT Pub. No.: WO2004/003272

PCT Pub. Date: Jan. 8, 2004

(65) Prior Publication Data

US 2006/0083923 A1 Apr. 20, 2006

(30) Foreign Application Priority Data

| | | |
|---|---|---|
| Jun. 26, 2002 | (JP) | 2002-186418 |
| Aug. 19, 2002 | (JP) | 2002-238458 |
| Aug. 20, 2002 | (JP) | 2002-239698 |
| Sep. 10, 2002 | (JP) | 2002-264463 |
| Sep. 10, 2002 | (JP) | 2002-264464 |
| Sep. 10, 2002 | (JP) | 2002-264465 |
| Oct. 22, 2002 | (JP) | 2002-307544 |
| Oct. 29, 2002 | (JP) | 2002-314706 |
| Oct. 29, 2002 | (JP) | 2002-314707 |
| Oct. 29, 2002 | (JP) | 2002-314708 |
| Oct. 29, 2002 | (JP) | 2002-314709 |
| Oct. 29, 2002 | (JP) | 2002-314710 |
| Nov. 1, 2002 | (JP) | 2002-319829 |

(51) Int. Cl.
*D02G 3/00* (2006.01)

(52) U.S. Cl. ..... 428/364; 428/394

(58) Field of Classification Search ..... 428/364, 428/394, 357, 359
See application file for complete search history.

(56) References Cited

U.S. PATENT DOCUMENTS

| | | | | |
|---|---|---|---|---|
| 5,001,003 | A | 3/1991 | Mahr | |
| 5,097,784 | A | 3/1992 | Baudet | |
| 5,403,641 | A | 4/1995 | Linville et al. | |
| 5,527,609 | A * | 6/1996 | Yabuki et al. | 428/359 |
| 5,552,221 | A * | 9/1996 | So et al. | 428/373 |
| 5,780,152 | A * | 7/1998 | Ichiryu et al. | 428/357 |
| 5,851,460 | A * | 12/1998 | Bauer et al. | 264/43 |
| 5,993,963 | A * | 11/1999 | Teramoto et al. | 428/364 |
| 6,335,419 | B2 * | 1/2002 | Matsuoka et al. | 528/183 |
| 7,189,346 | B2 * | 3/2007 | Lee | 264/184 |

FOREIGN PATENT DOCUMENTS

| | | | |
|---|---|---|---|
| JP | 8027623 | | 1/1996 |
| JP | 11228820 | | 8/1999 |
| JP | 2001 011311 | | 1/2001 |
| JP | 2001 172845 | | 6/2001 |
| JP | 200516839 | A * | 6/2005 |
| JP | 200517985 | A * | 7/2005 |
| JP | 2005179850 | A * | 7/2005 |
| JP | 2005179852 | A * | 7/2005 |
| WO | WO 96/10661 | | 11/1996 |

OTHER PUBLICATIONS

Supplementary European Search Report EP 03761809.7, PCT/JP0308066, Issued Jul. 6, 2006.

* cited by examiner

*Primary Examiner*—N. Edwards
(74) *Attorney, Agent, or Firm*—Kenyon & Kenyon LLP

(57) ABSTRACT

The present invention relates to polybenzazole fibers or filaments, staple fibers, spun yarns, and woven or knitted fabrics containing in themselves an organic pigment having heat resistance as high as a thermal decomposition temperature of 200° C. or higher, and soluble in a mineral acid and having group(s) of —N═ and/or NH— in the molecule, such as any of perinones and/or perylenes, any of phthalocyanines, any of quinacridones, and any of dioxazines, wherein they have a strength retention of 50% or higher when exposed to light from a xenon lamp for 100 hours and having a tensile strength retention of 85% or higher after exposed to an atmosphere of a temperature of 80° C. and a relative humidity of 80% for 700 hours.

The polybenzazole fibers or filaments, staple fibers, spun yarns, and woven or knitted fabrics can be used for cords for reinforcing rubber, sheets and rods for reinforcing cement/concrete, composite materials, sail clothes, ropes, knife proof vests and bullet proof vests.

18 Claims, No Drawings

POLYBENZAZOLE FIBER AND USE THEREOF

FIELD OF THE INVENTION

The present invention relates to polybenzazole fibers or filaments which have high durability when exposed to atmospheres of high temperatures and high humidity, and the use thereof.

BACKGROUND OF THE INVENTION

As fibers or filaments having high strength and high heat resistance, there are known polybenzazole fibers or filaments comprising polybenzoxazole or polybenzothiazole, or a copolymer thereof.

Generally, polybenzazole fibers or filaments are produced by extruding from the spinneret a dope containing the above polymer or copolymer and an acid solvent; dipping the fibers or filaments of the dope in a fluid such as water or a mixture of water and an inorganic acid, thereby solidifying the same; thoroughly washing the fibers or filaments in a water bath to remove most of the solvent; allowing the fibers or filaments to pass through a bath holding an aqueous solution of an inorganic base such as sodium hydroxide or the like to thereby neutralize the residual acid which is not extracted from the fibers or filaments; and drying the same.

The polybenzazole fibers or filaments thus produced have found a variety of applications, because they are superior in mechanical properties such as strength, and also higher in heat resistance, as mentioned above. Recently, the polybenzazole fibers or filaments are demanded to have further improved properties, particularly to sufficiently maintain the strength even after exposed to atmospheres of high temperatures and high humidity over long periods of time.

The polybezazole fibers or filaments are used as heat resistant cushion materials for supporting hot products without flawing them, in the manufacturing steps in the fields of iron and steel, ceramics and non-ferrous metal industries, because of their superior mechanical properties such as high strength and high heat resistance. When the polybenzazole fibers or filaments are used as heat resistant cushion materials, they are used for hot products which mostly maintain temperatures of 350° C. or higher immediately after subjected to molding. In some cases, the heat-accumulated cushion materials (or felt materials) are used while being cooled with water. Therefore, recently, there are earnest demands for felt materials comprising the polybenzazole fibers or filaments which can sufficiently maintain the strength even when exposed to atmospheres of high temperatures and high humidity over long periods of time.

Further, the polybenzazole fibers or filaments are used as textile materials for protective materials, proof clothing and industrial materials, because of their superior mechanical properties such as strength and elastic modulus. However, the polybenzazole fibers or filaments are expected to have further improved properties. Particularly, there are demands for woven or knit fabrics made from polybenzazole fibers or filaments capable of sufficiently maintaining the strength when exposed to atmospheres of high temperatures and high humidity and light irradiation over long periods of time.

While nylon fibers, polyester fibers, glass fibers and steel fibers are mainly used as rubber reinforcements for tires, hoses, belts, etc., recently, aromatic polyamide fibers, represented by Kevlar, having high strength and high elastic modulus are used as rubber reinforcements. On the other hand, the polybenzazole fibers or filaments have attracted the attentions of those skilled in the art as rubber reinforcements, since they have far higher strength and elastic modulus and superior heat resistance and dimensional stability as compared with the aromatic polyamide fibers. The use of the polybenzazole fibers or filaments as reinforcing fibers in the applications required to have higher strength and higher heat resistance is contemplated in the field of rubber materials for which the existing organic fibers are insufficient as reinforcing fibers in view of mechanical properties. As mentioned above, the polybenzazole fibers or filaments are used as the rubber-reinforcing fibers, because of the excellent mechanical properties such as strength and elastic modulus. Especially, there are earnest demands for rubber reinforcement comprising such polybenzazole fibers or filaments that can sufficiently maintain the strength when dynamic fatigue is applied to a reinforced rubber body containing the same and when the rubber body has a high temperature and high humidity therein.

Steel has hitherto been used as a reinforcement for cement/concrete, and recently, reinforcements containing glass fibers, carbon fibers or aramid fibers have been developed and put into practical use. Carbon fibers are very excellent in mechanical properties but are electrically conductive, and therefore can not be used in the proximity of power lines. On the other hand, aramid fibers have relatively sufficient properties, but have lower elastic modulus than carbon fibers, and therefore, their reinforcing effects are poor. Cement/concrete-reinforcing sheets comprising the polybenzazole fibers or filaments exhibit higher reinforcing effects over the aramid fibers and carbon fibers, and thus are expected as products of the next generation. The polybenzazole fibers or filaments are used in the cement/concrete-reinforcing sheets, because of their excellent mechanical properties such as strength and elastic modulus as mentioned above, but are demanded to be further improved in light resistance and the like. Especially, there are earnest demands for polybenzazole fiber sheets for reinforcing cement/concrete, capable of sufficiently maintaining the strength when exposed to atmospheres of high temperatures and high humidity over long periods of time.

Reinforcing steels have hitherto been used as rod-like cement/concrete reinforcing materials, and recently, reinforcing materials comprising aramid fibers have been developed and put into practical use. The marked features of aramid fiber rods rest in non-magnetism and non-electric conductivity, and thus, they can be used as the reinforcing rods of cement/concrete constructions in which the reinforcing steels can not be used. Polybenzazole fiber rods which are likewise non-magnetic and non-conductive show superior reinforcing effects over the aramid fiber rods and are expected as products of the next generation. The polybenzazole fibers or filaments, excellent in mechanical properties such as strength and elastic modulus, are used as reinforcing materials for cement/concrete, but are demanded to be further improved in properties to thereby provide polybenzazole fiber rods for reinforcing cement/concrete, capable of sufficiently maintaining the strength when exposed to atmospheres of high temperatures and high humidity over long periods of time.

The polybenzazole fibers or filaments excellent in mechanical properties such as strength and elastic modulus are used as textile materials for protective materials, proof clothes and industrial materials, as mentioned above. They are expected to have further improved properties. Especially, there are earnest demands for spun yarns comprising polybenzazole fibers or filaments capable of sufficiently maintaining the strength when exposed to atmospheres of high temperatures and high humidity and light irradiation over long periods of time.

As compounding materials for reinforcing fibers, glass fibers have been used. Recently, carbon fibers or aramid fibers are used to provide composite materials having higher strength and lighter weights, and such products have already been developed and put into practical use. Carbon fibers are very excellent in mechanical properties but are fragile because of the poor impact resistance. Aramid fibers are relatively sufficient in impact resistance, but are lower in elastic modulus than carbon fibers, and therefore show poor reinforcing effects. Composite materials comprising the polybenzazole fibers or filaments are sufficient in both impact resistance and elastic modulus, and show superior reinforcing effects over the composite materials comprising carbon fibers. Thus, the polybenzazole fiber composite materials are expected as products of the next generation.

The polybenzazole fibers or filaments are also used as the fiber-reinforced composite materials, because of their excellent mechanical properties such as strength and elastic modulus, as mentioned above, but are demanded to be further improved in properties such as light resistance and so on. Especially, there are earnest demands for composite materials comprising polybenzazole fibers or filaments excellent in durability and capable of sufficiently maintaining the strength when exposed to atmospheres of high temperatures and high humidity over long periods of time.

Sail cloths comprising the polybenzazole fibers or filaments are widely used. Especially, the sails of yachts for use in yacht races are required to have high resistance to pull strength and high tensile strength so that the sails of designed shapes can not be deformed by winds. Recently, lamination-molded sail cloths are dominantly used, which are manufactured by sandwiching a woven fabric or a scrim comprising fibers with high strength and high elastic modulus between two films such as polyester films and laminating them, and molding the lamination, as disclosed in U.S. patent Ser. Nos. 5,001,003 and 5,403,641. Further as disclosed in U.S. patent Ser. No. 5,097,784, a method of integrally molding a three-dimensional yacht sail is developed. Examples of the sail cloth referred to in the description of the present invention include such three-dimensional integrally molded articles. Paraaramid fibers and carbon fibers have been used for products made by such techniques. Carbon fibers have higher tensile modulus of elasticity than paraaramid fibers, and thus are expected to improve the performance of the sails of yachts, but such sails are weak against bending and thus poor in fatigue life. To overcome these problems, the sails of yachts comprising the polybenzazole fibers or filaments have been developed and have already proved their excellent performance in the worldwide yacht races. However, the yacht sails comprising the polybenzazole fibers or filaments have problems in that their initial performance is very high, but deteriorates due to solar light. Therefore, such yacht sails are broken, for example, in the course of a long term round-the-world yacht race. In such a long term race, a plurality of yacht sails are loaded on the yacht and are exposed to an atmosphere of high temperature and high humidity. The polybenzazole fibers or filaments tend to lower in strength under such an atmosphere, and therefore are demanded to have improved durability in this sense.

The polybenzazole fibers or filaments have been widely used for ropes such as yacht ropes which are required to have high strength and high abrasion resistance, because of their excellent mechanical properties such as strength and high heat resistance as mentioned above. However, the polybenzazole fibers or filaments are subject to mechanical damages in the course of the manufacturing of ropes, because of the very highly oriented molecular chain structures thereof. Therefore, the ropes comprising the polybenzazole fibers or filaments are inferior in long age durability under atmospheres of high temperatures and high humidity, as compared with the polybenzazole fibers or filaments themselves.

Aramid fibers have been used for knife proof vests so far. Lately, knife proof vests made from high strength polyethylene fibers have been developed and put into practical use. However, numerous aramid fibers are needed for such knife proof vests so as to exhibit required protective performance. Therefore, one can not continuously wear such a vest, because it is thick and heavy in weight and is not comfortable to wear. On the other hand, knife proof vests made from high strength polyethylene fibers are reduced in weight but not in thickness because the specific gravity thereof is small. Knife proof vests made from the polybenzazole fibers or filaments show superior protective performance to the knife proof vests of the aramid fibers and the knife proof vests of the high strength polyethylene fibers, and are expected as lightweight and thin knife proof vests of the next generation. While the polybenzazole fibers or filaments are used in knife proof vests because of their excellent mechanical properties such as strength and elastic modulus as mentioned above, further improvement of other properties such as light resistance are expected for the polybenzazole fibers or filaments. Especially, there are earnest demands for knife proof vests made from polybenzazole fibers or filaments capable of sufficiently maintaining the strength when exposed to atmospheres of high temperatures and high humidity over long periods of time.

While aramid fibers have hitherto been used for bullet proof vests, lately, bullet proof vests made from high strength polyethylene fibers have bee developed and put into practical use. However, numerous aramid fibers are needed for such bullet proof vests so as to exhibit required protective performance. Therefore, one can not continuously wear such a vest, because it is thick and heavy in weight and is not comfortable to wear. On the other hand, bullet proof vests made from high strength polyethylene fibers are reduced in weight but not in thickness because the specific gravity thereof is small. Bullet proof vests made from the polybenzazole fibers or filaments show superior protective performance to the bullet proof vests of the aramid fibers and the bullet proof vests of the high strength polyethylene fibers, and are expected as lightweight and thin bullet proof vests of the next generation. While the polybenzazole fibers or filaments are used in bullet proof vests because of their excellent mechanical properties such as strength and elastic modulus as mentioned above, further improvement of other properties such as light resistance are expected for the polybenzazole fibers or filaments. Especially, there are earnest demands for bullet proof vests made from polybenzazole fibers or filaments capable of sufficiently maintaining the strength when exposed to atmospheres of high temperatures and high humidity over long periods of time.

Under the foregoing circumstances, the present invention has been developed, and objects of the invention are to provide polybenzazole fibers or filaments whose strength hardly deteriorates even when exposed to atmospheres of high temperatures and high humidity over long periods of time, and the uses thereof.

DISCLOSURE OF THE INVENTION

The present inventors have extensively researched in order to overcome the foregoing problems, and finally accomplished the present invention.

The present invention is constituted as follows.

1. Polybenzazole fibers or filaments having a tensile strength retention of 85% or higher after exposed to an atmosphere of a temperature of 80° C. and a relative humidity of 80% for 700 hours.

2. Polybenzazole fibers or filaments according to the above paragraph 1, characterized in that the fibers or filaments have a strength retention of 50% or higher when exposed to light from a xenon lamp for 100 hours.

3. Polybenzazole fibers or filaments according to the above paragraph 1, characterized in that the fibers or filaments contain in themselves an organic pigment having heat resistance as high as a thermal decomposition temperature of 200° C. or higher, and soluble in a mineral acid.

4. Polybenzazole fibers or filaments according to the above paragraph 1, characterized in that the organic pigment contained in the fibers or filaments has group(s) of —N═ and/or NH— in the molecule.

5. Polybenzazole fibers or filaments according to the above paragraph 1, characterized in that the organic pigment contained in the fibers or filaments is any of perinones and/or perylenes.

6. Polybenzazole fibers or filaments according to the above paragraph 1, characterized in that the organic pigment contained in the fibers or filaments is any of phthalocyanines.

7. Polybenzazole fibers or filaments according to the above paragraph 1, characterized in that the organic pigment contained in the fibers or filaments is any of quinacridones.

8. Polybenzazole fibers or filaments according to the above paragraph 1, characterized in that the organic pigment contained in the fibers or filaments is any of dioxazines.

9. Polybenzazole staple fibers having a tensile strength retention of 85% or higher after exposed to an atmosphere of a temperature of 80° C. and a relative humidity of 80% for 700 hours.

10. A spun yarn comprising polybenzazole fibers or filaments as at least one component, the spun yarn having a tensile strength retention of 70% or higher after exposed to an atmosphere of a temperature of 80° C. and a relative humidity of 80% for 700 hours.

11. A cord for reinforcing rubber, comprising twisted yarns of polybenzazole fibers or filaments, the cord having a tensile strength retention of 70% or higher after exposed to an atmosphere of a temperature of 80° C. and a relative humidity of 80% for 700 hours.

12. A polybenzazole fiber sheet for reinforcing cement/concrete, having a tensile strength retention of 75% or higher after exposed to an atmosphere of a temperature of 80° C. and a relative humidity of 80% for 700 hours.

13. A polybenzazole fiber rod for reinforcing cement/concrete, having a tensile strength retention of 75% or higher after exposed to an atmosphere of a temperature of 80° C. and a relative humidity of 80% for 700 hours.

14. A composite material comprising polybenzazole fibers or filaments as at least one component, the composite material having a tensile strength retention of 75% or higher after exposed to an atmosphere of a temperature of 80° C. and a relative humidity of 80% for 700 hours.

15. A sail cloth excellent in durability, comprising polybenzazole fibers or filaments, the sail cloth having a tensile strength retention of 80% or higher in the fiber axial direction, after exposed to an atmosphere of a temperature of 80° C. and a relative humidity of 80% for 700 hours.

16. A high strength fiber rope comprising polybenzazole fibers or filaments, the fiber rope having a tensile strength retention of 85% or higher after exposed to an atmosphere of a temperature of 80° C. and a relative humidity of 80% for 700 hours.

17. A knife proof vest comprising polybenzazole fibers or filaments at least one component, the knife proof vest having a tensile strength retention of 75% or higher after exposed to an atmosphere of a temperature of 80° C. and a relative humidity of 80% for 700 hours.

18. A bullet proof vest comprising polybenzazole fibers or filaments at least one component, the bullet proof vest having a tensile strength retention of 75% or higher after exposed to an atmosphere of a temperature of 80° C. and a relative humidity of 80% for 700 hours.

Hereinafter, the present invention will be explained in more detail. Examples of the organic pigment which has heat resistance as high as a thermal decomposition temperature of 200° C. or higher and which is soluble in a mineral acid include insoluble azo pigments, condensed azo pigments, lakes, isoindolinones, isoindolines, dioxazines, perinones and/or perylenes, phthalocyanines, quinacridones and the like. Among those, preferred are organic pigments each having group(s) of —N═ and/or NH— in the molecule, and more preferred are dioxazines, perinones and/or perylenes, phthalocyanines and quinacridones.

Examples of the perinones and/or perylenes include bisbenzimidazo[2,1-b:2',1'-i]benzo[1nm][3,8]phenanthroline-8,17-dione, bisbenzimidazo[2,1-b:1',2'-j]benzo[1mn][3,8]phenanthroline-6,9-dione, 2,9-bis(p-methoxybenzyl)anthra[2,1,9-def:6,5,10-d'e'f']diisoquinoline-1,3,8,10(2H,9H)-tetrone, 2,9-bis(p-ethoxybenzyl)anthra[2,1,9-def:6,5,10-d'e'f']diisoquinoline-1,3,8,10(2H,9H)-tetrone, 2,9-bis(3,5-dimethylbenzyl)anthra[2,1,9-def:6,5,10-d'e'f']diisoguinoline-1,3,8,10(2H,9H)-tetrone, 2,9-bis(p-methoxyphenyl)anthra[2,1,9-def:6,5,10-d'e'f']diisoquinoline-1,3,8,10(2H,9H)-tetrone, 2,9-bis(p-ethoxyphenyl)anthra[2,1,9-def:6,5,10-d'e'f']diisoquinoline-1,3,8,10(2H,9H)-tetrone, 2,9-bis(3,5-dimethylphenyl)anthra[2,1,9-def:6,5,10-d'e'f']diisoquinoline-1,3,8,10(2H,9H)-tetrone, 2,9-dimethylanthra[2,1,9-def:6,5,10-d'e'f']diisoquinoline-1,3,8,10(2H,9H)-tetrone, 2,9-bis(4-phenylazophenyl)anthra[2,1,9-def:6,5,10-d'e'f']diisoquinoline-1,3,8,10(2H,9H)-tetrone, 8,16-pyranthlenedione, and the like.

Each of these perinones may be used alone or in combination. The amount of perinone(s) to be added is 0.01 to 20%, preferably 0.1 to 10% based on the amount of polybenzazole.

As the phthalocyanines, any of the compounds each having a phthalocyanine ligand may be used, independently of the presence or absence of a coordinate metal at the center of the ligand and the species of the atom.

Specific examples of these compounds include 29H,31H-phthalocyaninate(2-)-N29,N30,N31,N32 copper, 29H,31H-phthalocyaninate(2-)-N29,N30,N31,N32 iron, 29H,31H-phthalocyaninate-N29,N30,N31,N32 cobalt, 29H,31H-phthalocyaninate(2-)-N29,N30,N31,N32 copper, oxo(29H,31H-phthalocyaninate(2-)-N29, N30, N31, N32), (SP-5-12) titanium, and the like. Any of these phthalocyanine ligands may have at least one substituent selected from a halogen atom, methyl group, methoxy group and the like.

Each of these phthalocyanines may be used alone or in combination. The amount of the phthalocyanine(s) is 0.01 to 20%, preferably 0.1 to 10%, based on the amount of polybenzazole.

Examples of the quinacridones include 5,12-dihydro-2,9-dimethylquino[2,3-b]acridine-7,14-dione, 5,12-dihydroquino[2,3-b]acridine-7,14-dione, 5,12-dihydro-2,9-dichloroquino[2,3-b]acridine-7,14-dione, 5,12-dihydro-2,9-dibromoquino[2,3-b]acridine-7,14-dione, and the like.

Each of these quinacridones may be used alone or in combination. The amount of the quinacrione(s) to be added is 0.01 to 20%, preferably 0.1 to 10%, based on the amount of polybenzazole.

Examples of the dioxazines include 9,19-dichloro-5,15-diethyl-5,15-dihydrodiindolo[2,3-c:2',3'-n]triphenodioxazine, 8,18-dichloro-5,15-diethyl-5,15-dihydrodiindolo[3,2-b:3',2'-m]triphenodioxazine, and the like. Each of these dioxazines may be used alone or in combination. The amount of the dioxazine(s) to be added is 0.01 to 20%, preferably 0.1 to 10%, based on the amount of polybenzazole.

At least two, three or more compounds selected from the perylenes, the perinones, the phthalocyanines, the quinacridones and the dioxazines may be used in combination.

The organic pigments of the present invention are not limited to the foregoing in any way.

The polybenzazole fibers or filaments referred to in the present invention mean fibers or filaments comprising a polybenzazole polymer, and polybenzazole (PBZ) means at least one polymer selected from the group consisting of polybenzoxazole (PBO), polybezothiazole (PBT) and polybenzimidazole (PBI). In the present invention, PBO means a polymer having an oxazole ring bonded to an aromatic group which is not necessarily a benzene ring. Examples of PBO include polymers each having a plurality of oxazole ring units bonded to a poly(p-phenylenebenzobisoxazole) or an aromatic group. The similar definition can be applied to PBT and PBI. Examples of polybenzazole (PBZ) include mixtures, copolymers and block polymers of at least two polybenzazole polymers of PBO, PBT and PBI, such as mixtures of PBO, PBT and PBI, or block or random copolymers of PBO, PBT and PBI. Preferably, the polybenzazole is a lyotropic liquid crystal polymer which forms a liquid crystal in a mineral acid at a specified concentration.

Preferably, the constituent unit contained in a PBZ polymer is selected from the lyotropic liquid crystal polymers. This polymer comprises a monomer unit represented by any of the structural formulae (a) to (i) as below.

(a)

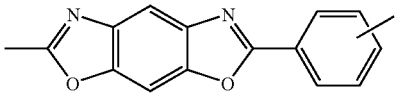

(b)

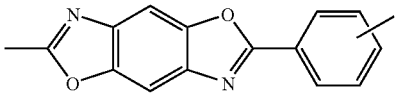

(c)

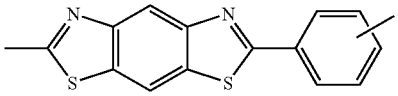

-continued (d)

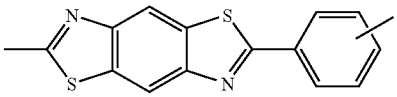

(e)

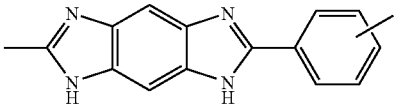

(f)

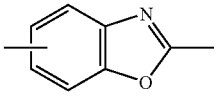

(g)

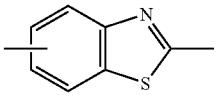

(h)

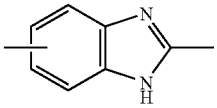

(i)

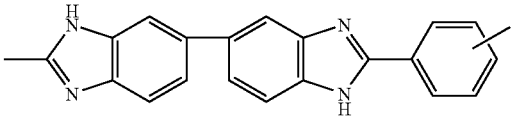

Polybenzazole fibers or filaments are formed from a solution of a polybenzazole polymer (a PBZ polymer dope). As a suitable solvent for preparing the dope, cresol or a non-oxidizing mineral acid capable of dissolving the polymer can be used. Examples of preferred non-oxidizing mineral acid include polyphosphoric acid, methanesulfonic acid, highly concentrated sulfuric acid, and mixtures thereof. Among those, polyphosphoric acid and methanesulfonic acid are preferred. Above all, polyphosphoric acid is preferred.

The concentration of the polymer in the dope is 1 to 30%, preferably 1 to 20%. The highest concentration of the polymer is limited depending on the handling conditions for practical use, such as the solubility of the polymer and the viscosity of the dope. Because of such critical factors, generally, the concentration of the polymer never exceeds 20 wt. %.

In the present invention, suitable polymers or copolymers and dopes are prepared by any of known methods, described, for example, in U.S. Pat. No. 4,533,693 by Wolfe et al. (Aug. 6, 1985), U.S. Pat. No. 4,772,678 by Syberts et al. (Sep. 22, 1988), U.S. Pat. No. 4,847,350 by Harris (Jul. 11, 1989) and U.S. Pat. No. 5,089,591 by Gregory et al. (Feb. 18, 1992). To sum up, suitable monomers or copolymer can be reacted in a solution of a non-oxidizing and dehydrating acid, by raising the temperature stepwise or at a given rate within a range of about 60° C. to about 230°, while stirring and shearing at high speeds under a non-oxidizing atmosphere.

The dope thus prepared is extruded from a spinneret, and the extrusions are elongated in an air to form fibers or filaments. Preferred methods therefor are described in the above patent literature and U.S. Pat. No. 5,034,250. The dope extrusions from the spinneret enter a space between the spinneret and a washing bath. This space is generally called an air gap, but is not always charged with an air. It is needed to fill this space with a medium which does not act to remove the solvent and which is non-reactive with the dope, such as an air, nitrogen, argon, helium, carbon dioxide or the like.

The fibers or filaments spun are washed to avoid excessive elongation thereof and to remove a part of the solvent. The fibers or filaments are further washed and neutralized with a suitable inorganic base such as sodium hydroxide, calcium hydroxide, potassium hydroxide or the like to thereby remove most of the solvent. The washing herein referred to means that the fibers or filaments are allowed to contact a liquid which is compatible with the mineral acid dissolving the polybenzazole polymer and which is not a solvent for the polybenzazole polymer, so as to remove the acid solvent from the dope. As a suitable washing liquid, water or a mixture of water and an acid solvent can be used. Preferably, the fibers or filaments are so washed that the concentration of the residual mineral acid can be 8,000 ppm or lower, more preferably 5,000 ppm or lower. After that, the fibers or filaments are dried, heat-treated and wound, as required.

If needed, the fibers or filaments are crimped with a push-on crimper or the like. Then, the fibers or filaments are cut into staple fibers with predetermined lengths, using, for example, a rotary cutter having a plurality of blades disposed radially in a slit between a pair of rotors opposing to each other. The length of the staple fibers is not particularly limited, and it is preferably 100 to 0.05 mm, more preferably 70 to 0.5 mm.

The resultant polybenzazole staple fibers have so excellent durability as a tensile strength retention of 85% or higher, preferably 90% even after exposed to an atmosphere of a temperature as high as 80° C. and a relative humidity as high as 80% for 700 hours. The breaking strength of the staple fibers is 1 GPa or more, preferably 2.75 GPa or more, more preferably 4.10 GPa or more.

The polybenzazole staple fibers can be widely used. The staple fibers are variously processed to provide spun yarns, felt, etc. Such spun yarns and felt are used for tension members such as cables and ropes; incision protective materials such as gloves; heat resistant and fire resistant materials such as fireman uniforms, heat resistant felt, gaskets for plants, heat resistant fabrics, a variety of sealing materials, heat resistant cushions and filters; abrasion resistant materials such as continuous vehicle transmission belt and clutch facing; reinforcements for construction materials; rider suits; speaker cones; and the like. The applications of the staple fibers are not limited to those.

Spun yarns comprising the polybenzazole fibers or filaments obtained as above are excellent in durability: that is, the spun yarns have a tensile strength retention of 70% or higher, preferably 75% or higher after exposed to an atmosphere of a temperature of 80° C. and a relative humidity of 80% for 700 hours. The use of such spun yarns makes it possible to provide textile materials for highly durable protective materials, protective clothing and industrial materials.

Examples of the spun yarns of the present invention also include composite spun yarns which comprise the polybenzazole fibers or filaments with other fibers. As other fibers, there are given natural fibers, organic fibers, metal fibers, inorganic fibers and mineral fibers. There is no particular limit in selection of the blending method, and the conventional mixed staple fiber at opening process, and core-in sheath method can be employed.

The polybenzazole fibers or filaments obtained as above are crimped and cut into polybenzazole staple fibers, which are further finished into felt by any of known methods.

As the felt-making method, a known non-woven fabric making method can be employed. A web is formed from the staple fibers, and the web is formed into felt by the needle punching method, stitch bonding method or water punching method, or by a method using a binder. Otherwise, felt may be made from the polybenzazole filaments by the spunbonding method.

Felt materials of the present invention can be made from blended staple fibers comprising the polybenzazole fibers or filaments and different fibers. It is effective to increase the blending percentage of the polybenzazole fibers or filaments, when the felt material is demanded to have higher heat resistance. The weight percentage of the polybenzazole fibers or filaments is preferably 50% or higher, more preferably 80% or higher. When it is less than 50%, the excellent heat resistance and abrasion resistance of the polybenzazole fibers or filaments may not be fully exhibited. There is no particular limit in selection of the blending method, in so far as felt comprises homogeneously blended fibers, or comprises a lamination having two or more felt layers which are made separately from different fibers to be blended with the polybenzazole fibers or filaments, and such felts are moldable.

The felt material thus obtained can sufficiently maintain the strength even after exposed to an atmosphere of high temperature and high humidity, since it comprises the polybenzazole fibers or filaments which show less decrease in strength even after exposed to an atmosphere of high temperature and high humidity over a long period of time. As a result, the abrasion resistance of the felt material under an atmosphere of high humidity is improved, which makes it possible to improve the life of the heat resistant cushion material comprising the felt material.

Woven or knitted fabrics comprising the polybenzazole fibers or filaments thus obtained have high durability: that is, the fabrics have a tensile strength retention of 70% or higher, preferably 75% or higher, after exposed to an atmosphere of a temperature of 80° C. and a relative humidity of 80% for 700 hours. The use of such woven or knitted fabrics makes it possible to provide textile materials for highly durable protective materials, protective clothing and industrial materials.

Examples of the woven or knitted fabrics of the present invention also include composite woven or knitted fabrics combined with other fibers or filaments such as natural fibers, organic fibers, metal fibers, inorganic fibers, mineral fibers or the like. The method of combination is not limited. The woven fabrics include union woven fabrics, double weave fabrics, lip stop fabrics, etc. The knitted fabrics include union knitted fabrics, circular knitted fabrics, weft knitted fabrics, warp knitted fabrics, raschel knitted fabrics, etc. Fiber or filament fluxes composing the woven or knitted fabrics are not particularly limited. Monofilaments, multifilaments, twist yarns, composite twisted yarns, covering yarns, spun yarns, stretch breaking spun yarns, core-in-sheath yarns and braids can be used.

The polybenzazole fibers or filaments of the present invention are twisted as single twist yarns or twist two-ply yarns, using a ring twisting machine, so as to improve the fatigue resistance. The twist coefficient is sufficient to be 350 to 2,000.

The twist coefficient $K=Tw\times(\mathrm{Den}/\rho)^{1/2}$

Tw: the number of twist [T/10 cm],

Den: total denier

ρ: fiber density [g/cm$^3$]

To improve the adhesion to rubber, the surfaces of the polybenzazole fibers or filaments may be subjected to corona treatment or plasma treatment. Otherwise, a compound reactive with the surfaces of the polybenzazole fibers or filaments or the surface of the polybenzazole fibers or filaments treated with corona may be applied to such polybenzazole fibers or filaments. To further improve the adhesion to rubber, the polybenzazole fibers or filaments may be subjected to a dipping treatment. As the treating liquid, the following can be generally used:

(A) an aqueous dispersion of an epoxy resin, (B) an aqueous dispersion of a blocked isocyanate, (C) an aqueous dispersion of a rubber latex, and (D) a liquid mixture of a resorcin formaldehyde resin and a rubber latex (RFL).

Each of the treating liquids may be used alone or in combination, for one-stage or multiple-stage treatment comprising two or more steps. Other treating methods may be employed.

The polybenzazole fiber sheets for cement/concrete reinforcement of the present invention are 100 to 1,500 g/m$^2$ in weight, and the sheets comprise the polybenzazole fibers or filaments in at least one direction thereof. When the weight of the sheet is below 100 g/m$^2$, the sheet can not have a required strength, which leads to the need of laminating an increased number of such sheets, resulting in poor efficiency. When the weight exceeds 1,500 g/cm$^2$, the impregnation of a resin as adhesive into the sheet becomes poor, and the adhesion with cement and concrete becomes poor. The fiber sheet specifically means a woven fabric, knitted fabric, non-woven fabric, net, net-like sheet in which the intersections of fibers or filaments are fixed with adhesive, lamination of fibers or filaments on a film, or the like. The strength of the fiber sheet is at least 50 kg/cm, preferably at least 100 kg/cm. When the strength is below 50 kg/cm, the effect of reinforcing cement/concrete can not be obtained. Generally, cement/concrete is reinforced with the fiber sheet by simply winding the sheet around the cement/concrete, or by sticking the fiber sheet thereto. Otherwise, the fiber sheet under a proper tension is wound around a bridge pier and bonded thereto, or is bonded to the base of a bridge. The fiber sheet of the present invention can be applied by any of the above methods.

The highly durable composite materials comprising the polybenzazole fibers or filaments of the present invention may be reinforced by using the polybenzazole fibers or filaments for one direction of the materials, by a pseudocubic lamination, or by laminating fabrics. As the matrix resin, any of thermosetting resins such as epoxy resins and phenol resins, super engineering plastics such as PPS and PEEK, and general-purpose thermoplastic resins such as PE, PP and polyamide can be used.

It is essential that the sail cloth of the present invention partially comprises the polybenzazole fibers or filaments which contain an organic pigment. For example, such polybenzazole fibers or filaments are used in combination with other high strength fibers such as polyethylene fibers, paraaramid fibers, wholly aromatic polyester fibers or carbon fibers. Sail cloths are reinforced with fibers in complicated directions. In the present invention, it is important to improve the strength retention of the sail cloth substantially in the fiber axial direction of the polybenzazole fibers or filaments.

Surprisingly, it is proved that high strength fiber ropes comprising such polybenzasole fibers or filaments are improved also in light resistance, although the action therefor is unknown. While the present invention is not restricted by any of the following consideration, it is considered that, because of the light-shielding effect of the highly heat resistant organic pigment, the light deterioration of the ropes is lessened, that the polybenzazole molecules excited by light irradiation is immediately returned to the normal states, or that radicals formed by the interaction with oxygen atoms are captured to thereby stabilize the reaction system.

The knife proof vests of the present invention are made of laminated woven fabrics of the polybenzazole fibers or filaments. The texture of the woven fabric may be any of plain weave, twill weave and other weaves for ordinary fabrics. Plain weave fabrics are preferred, since the textures thereof are hard to shift so that high knife proof performance can be realized. The fineness of the polybenzazole fibers or filaments of the present invention is 600 dtex or less, preferably 300 dtex or less. Advantageously, such low fineness fibers or filaments make it possible to achieve high knife proof performance. It is important that the number of yarns of the woven fabric of the present invention is 30/25 mm or more, preferably 50/25 mm or more. When the number of yarns is small, the yarns of the fabric tend to move so that sufficient knife proof performance can not be obtained. The weight of the fabric is 100 g/m$^2$ or more, preferably 150 g/m$^2$ or more, in which range, excellent knife proof performance can be exhibited. The fabric to be used in the present invention may be partially or fully coated or impregnated with a resin. The knife proof vest of the present invention is made of a lamination of such fabrics, or may be made of a plurality of such fabrics integrally sewn with a high strength machine sewing yarn.

The bullet proof vests of the present invention are made of laminated fabrics of the polybenzazole fibers or filaments. The texture of the fabric may be any of plain weave, twill weave and other weaves for ordinary fabrics. Plain weave fabrics or twill weave fabrics are preferred, since the texture of the fabric hardly shift, which makes it possible to achieve high bullet proof performance. The fineness of the polybenzazole fibers or filaments of the present invention is 1,110 dtex or lower, preferably 600 dtex or lower, and the use of the polybenzazole fibers or filaments with such a low fineness makes it easy to achieve high bullet proof performance. It is necessary that the number of the yarns of the fabric of the present invention should be 40/25 mm or less. The weight of the fabric is 200 g/cm$^2$ or less, preferably 150 g/m$^2$, in which range excellent bullet proof performance can be realized. The bullet proof vest of the present invention is made of a lamination of the above fabrics, or may be made of the above fabrics integrally sewn with a high strength machine sewing yarn.

Firstly, the polybenzazole fibers or filaments of the present invention are characterized in that the fibers or filaments contain an organic pigment, so that the fibers or filaments can have a tensile strength retention of 85% or higher after exposed to an atmosphere of a temperature of 80° C. and a relative humidity of 80% for 700 hours. The organic pigment herein referred to has a thermal decomposition temperature of 200° C. or higher and is soluble in a mineral acid, as mentioned above. Preferably, the organic pigment has group(s) of —N═ and/or NH— in the molecule. More preferably, the organic pigment is selected from perinones and/or perylenes, phthalocyanines, quinacridones and dioxazines. The mineral acid is a methanesufonic acid or a polyphosphoric acid.

The method of containing the organic pigment in the fibers or filaments is not limited, and the organic pigment may be contained at any of the steps of the polymerization of polybenzazole, or may be contained in the resultant polymer dope at the completion of the polymerization. For example, the organic pigment may be added simultaneously with the addition of raw materials for polybenzazole, or may be added at an optional point of time during the reaction promoted by increasing the temperature stepwise or at a given rate, or may be added to the reaction system after the completion of the polymerization, and stirred and mixed into the reaction system.

The polybenzazole fibers or filaments are washed with water, and dried usually at a temperature of 50° C. or higher and 300° C. or lower so that the organic pigment can be fixed in the fibers or filaments. The tensile strength retention of the polybenzazole fibers or filaments shows 80% or higher of that of polybenzazole fibers or filaments containing no organic pigment. Thus, it is known that adverse influence of the drying treatment on the polymer is a little.

Secondly, the polybenzazole fibers or filaments of the present invention are characterized in that the strength of the fibers of filaments can be sufficiently maintained without any disadvantage that the initial strength of the fibers or filaments decreases due to the organic pigment contained therein. The polybenzazole fibers or filaments can be smoothly spun so that the operation is efficiently continued without any yarn breakage. This is because the pigment added, soluble in a mineral acid, can be dissolved also in the resultant polymer dope. When the content of the organic pigment exceeds 20%, the fineness of the fibers or filaments increases. This is disadvantageous, because the initial strength of the resultant yarn becomes lower.

Thirdly, the polybenzazole fibers or filaments of the present invention are characterized in that the fibers or filaments are improved in light resistance. It is known that the strength of ordinary polybenzazole fibers or filaments decreases when they have been exposed to solar light for a long period of time. For example, the strength of poly(p-phenylenebenzobisoxazole) fibers or filaments decreases to about 15 to about 30% of the initial strength thereof, when the fibers or filaments have been irradiated with light from a xenon lamp for 100 hours. By contrast, the polybenzazole fibers or filaments of the present invention, which contain a highly heat-resistant organic pigment, can retain 50% or higher, preferably 75% or higher of the initial strength thereof after exposed to xenon radiation for 100 hours.

While the chemical conditions of the highly heat-resistant organic pigment contained in the fibers or filaments, or the actions thereof are not clearly known, the following can be supposed: since the micro voids in the polybenzazole fibers or filaments are filled with the molecules of the highly heat-resistant organic pigment, external water vapor is hard to reach the polybenzazole molecules even while the polybenzazole fibers or filaments are exposed to an atmosphere of high temperature and high humidity, so that the strength of the fibers or filaments are hard to decrease; or, the mineral acid remaining in the polybenzazole fibers or filaments is dissociated by moisture to release hydrogen ions, which are then captured by the organic pigment, so that the reaction system is neutralized to thereby inhibit the decrease of the strength of the fibers or filaments; or otherwise, the highly heat-resistant organic pigment having a developed conjugate system captures radicals which occur for some reason, to thereby stabilize the reaction system.

Similarly, it is supposed that the light resistance of the polybenzazole fibers or filaments is improved by the presence of the organic pigment. The highly heat-resistant organic pigment functions to shield light to thereby lessen the intensity of light irradiation to the fibers or filaments; or, the organic pigment functions to immediately return the polybenzazole molecules excited by light irradiation, to their normal states; or otherwise, the organic pigment captures radicals which occur due to the interaction between polybenzazole and oxygen atoms, to thereby stabilize the reaction system. While the foregoing reasons are considered, the present invention is not restricted by such consideration in any way.

BEST MODES FOR CARRYING OUT THE INVENTION

Hereinafter, the present invention will be explained in more detail by way of Examples, which, however, should not be construed as limiting the scope of the present invention in any way. Needless to say, modifications of Examples within a range adapted to the gist as described later are also possible, and such modifications are also included in the scope of the present invention.

The measuring methods in relation to Examples are conducted as follows.

(Evaluation of Strength of Filaments Under Atmosphere of High Temperature and High Humidity)

A decrease in strength of filaments under an atmosphere of high temperature and high humidity was evaluated as follows. A sample was prepared by winding filaments onto a paper cylinder with a diameter of 10 cm. This sample was stored in a constant temperature/humidity container at a high temperature and a high humidity. After that, the sample was removed from the container, and subjected to a tensile test at a room temperature, so as to evaluate the retention of the strength after the storage to the initial strength before the storage. The storage test under an atmosphere of high temperature and high humidity was conducted at a temperature of 80° C. and a relative humidity of 80% for 700 hours, using Humidic Chamber 1G43M manufactured by Yamato Kagakusha.

(Measurement of Filament Strength)

The strength retention was determined by measuring the initial tensile strengths of the sample before and after the storage test at high temperature and high humidity, and dividing the tensile strength after the storage test, by the initial tensile strength before the storage test. The tensile strength was measured according to the procedure of JIS-L1013, using a tension tester (AG-50 KNG manufactured by SHIMADZU CORPORATION).

(Measurement of Metal Concentration)

The concentration of the residual phosphorous in the filaments was measured using pellets obtained by solidifying the sample, with a fluorescent X-ray spectrometer (PW1404/DY685 manufactured by PHILIPS). The concentration of the sodium was measured by the neutron-activating analysis.

(Light Exposure Test)

A metal frame having a film fixed thereon was set on a water cooled xenon arc type weather meter (Ci35A model manufactured by ATLAS). Quartz was used for the internal filter glass, and borosilicate type S was used for the external filter glass. The film was continuously irradiated with light for 100 hours under the following conditions:

Illumination intensity: 0.35 W/m$^2$ (at 340 nm)

Temperature of black panel: 60° C.±3° C.

Internal humidity: 50%±5%

(Method of Evaluating Abrasion Resistance of Felt Material at High Temperature)

A sample was abraded with a high temperature abrasion tester by bringing a rubbing material heated at 500° C. into contact with the sample under a load of 300 g/cm$^2$, and rotating the sample at 300 rpm under this condition. Specifically, the sample was dipped in pure water for 10 seconds just before the abrasion test, and then abraded for 5 hours; and the sample was removed from the tester, again dipped in pure water for 10 seconds and again abraded. This operation was repeated until the sample had been abraded for total 20 hours. The abrasion resistance of the sample was evaluated based on a decrease in the weight of the sample found after the abrasion for 20 hours.

(Measurement of Strength of Woven or Knitted Fabric)

The strength retention of a fabric was determined by measuring the tensile strengths found before and after the storage test at a high temperature and a high humidity, and dividing the tensile strength found after the storage test by the initial tensile strength found before the storage test. The tensile strength of a woven fabric was measured according to the procedure of JIS-L1096, and that of a knitted fabric, according to the procedure of JIS-L1018, using a tension tester (AG-50KNG manufactured by SHIMADZ CORPORATION).

(Method of Measuring Strength)

The strength of a sail cloth was measured, using a sample with a width of 2.5 cm of the cloth, according to the procedure of JIS L1096.

Spinning was carried out so as to obtain filaments with diameters of 11.5 μm and fineness of 1.5 denier. A dope was extruded from a nozzle having 166 holes with diameters of 180 μm at a spinning temperature of 175° C., and the extruded filaments were pushed into a first washing bath which was so located as to cause the filaments to be converged at an appropriate position to form a multifilament. A quench chamber was located in an air gap between the nozzle and the first washing bath, so as to elongate the filaments at a more uniform temperature. The length of the air gap was 30 cm. The filaments were pushed out into an air at 60° C. The filament takeup rate was 200 m/min., and the filament elongation multiplying factor was 30. The filaments were washed with water until the concentration of the residual phosphorous in the polybenzazole filaments reached 6,000 ppm or less. The filaments were neutralized with a 1% NaOH aqueous solution for 10 seconds, washed with water for 30 seconds, dried at 200° C. for 3 minutes and wound onto a paper cylinder.

EXAMPLE 1

Under a stream of a nitrogen gas, 4,6-diamino-resorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours, and at 170° C. for 20 hours. The resultant poly(p-phenylenebenzobisoxazole) dope (2.0 kg) had an intrinsic viscosity of 30 dL/g at 30° C., which was measured by using a methanesulfonic acid solution. To the above dope (2.0 kg) was added 29H,31H-phthalocyaninate (2-)-N29,N30,N31,N32 copper (15.2 g), and the mixture was stirred. Then, the solution was spun into filaments by the foregoing method. The resultant filaments were subjected to a storage test at high temperature and high humidity (80° C. and 80 RH %) and a light exposure test. The results are shown in Table 1.

EXAMPLE 2

To a poly(p-phenylenebenzobisoxazole) dope (2.0 kg) having an intrinsic viscosity of 29 dL/g prepared in the same manner as in Example 1 was added bisbenzimidazo[2,1-b:2',1'-i]benzo[1mn][3,8]phenanthroline-8,17-dione (15.2 g), and the mixture was stirred. After that, the solution was spun by the foregoing method. The resultant filaments were subjected to a storage test at high temperature and high humidity (80° C. and 80 RH %) and a light exposure test. The results are shown in Table 1.

EXAMPLE 3

To a poly(p-phenylenebenzobisoxazole) dope (2.0 kg) having an intrinsic viscosity of 29 dL/g prepared in the same manner as in Example 1 was added 9,19-dichloro-5,15-diethyl-5,15-dihydrodiindlo[2,3-c:2',3'-n]triphenodioxazine (15.2 g), and the mixture was stirred. After that, the solution was spun by the foregoing method. The resultant filaments were subjected to a storage test at high temperature and high humidity (80° C. and 80 RH %) and a light exposure test. The results are shown in Table 1.

EXAMPLE 4

Under a stream of a nitrogen gas, 4,6-diamino-resorcinol dihydrochloride (334.5 g), terephthalic acid (260.8 g), bisbenzimidazo[2,1-b:2',1'-i]benzo[1mn][3,8]-phenanthroline-8,17-dione (19.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours, and at 170° C. for 20 hours. The resultant polymer dope of polyparaphenylenebenzobisoxazole had an intrinsic viscosity of 26 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 5

Under a stream of a nitrogen gas, 4,6-diamino-resorcinol dihydrochloride (334.5 g), terephthalic acid (260.8 g), 29H,31H-phthalocyaninate(2-)-N29,N30,N31,N32 copper (19.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours, and at 170° C. for 20 hours. The resultant polymer dope of polyparaphenylenebenzobisoxazole had an intrinsic viscosity of 28 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 6

Under a stream of a nitrogen gas, 4,6-diamino-resorcinol dihydrochloride (334.5 g), terephthalic acid (260.8 g), phthalocyanine green (19.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours, and at 170° C. for 20 hours. The resultant polymer dope of polyparaphenylenebenzobisoxazole had an intrinsic viscosity of 28 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 7

Under a stream of a nitrogen gas, 4,6-diamino-resorcinol dihydrochloride (334.5 g), terephthalic acid (260.8 g), 5,12-dihydro-2,9-dimethylquino[2,3-b]acridine-7,14-dione (19.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours, and at 170° C. for 20 hours. The resultant polymer dope of polyparaphenylenebenzobisoxazole had an intrinsic viscosity of 24 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 8

Under a stream of a nitrogen gas, 4,6-diamino-resorcinol dihydrochloride (334.5 g), terephthalic acid (260.8 g), bisbenzimidazo[2,1-b:1',2'-j]benzo[1mn][3,8]phenanthroline-6,9-dione (19.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours, and at 170° C. for 20 hours. The resultant polymer dope of polyparaphenylenebenzobisoxazole had an intrinsic viscosity of 28 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 9

Under a stream of a nitrogen gas, 4,6-diamino-resorcinol dihydrochloride (334.5 g), terephthalic acid (260.8 g), 2,9-bis(p-methoxybenzyl)anthra[2,1,9-def:6,5,10-d'e'f']diisoquinoline-1,3,8,10(2H,9H)-tetrone (19.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours, and at 170° C. for 20 hours. The resultant polymer dope of polyparaphenylenebenzobisoxazole had an intrinsic viscosity of 28 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 10

Under a stream of a nitrogen gas, 4,6-diamino-resorcinol dihydrochloride (334.5 g), terephthalic acid (260.8 g), 5,12-dihydroquino[2,3-b]acridine-7,14-dione (19.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours, and at 170° C. for 20 hours. The resultant polymer dope of polyparaphenylenebenzobisoxazole had an intrinsic viscosity of 26 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 11

Under a stream of a nitrogen gas, 4,6-diamino-resorcinol dihydrochloride (334.5 g) and terephthalic acid (252.7 g) were added to 122% polyphosphoric acid (2,165.5 g), and the mixture was stirred at 60° C. for 30 minutes. Then, the temperature was gradually increased, so that the mixture was reacted at 120° C. for 3.5 hours, at 135° C. for 20 hours, and at 150° C. for 5 hours. To the resultant oligomer dope were added terephthalic acid (5.6 g) and a dispersion of 29H, 31H-phthalocyaninate(2-)-N29,N30,N31,N32 copper (19.2 g) in 116% polyphosphoric acid (74.4 g). The mixture was reacted at 170° for 5 hours and at 200° C. for 10 hours. The resultant polymer dope of polyparaphenylenebenzobisoxazole had an intrinsic viscosity of 26 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 12

Under a stream of a nitrogen gas, 4,6-diamino-resorcinol dihydrochloride (334.5 g) and terephthalic acid (252.7 g) were added to 122% polyphosphoric acid (2,165.5 g), and the mixture was stirred at 60° C. for 30 minutes. Then, the temperature was gradually increased, so that the mixture was reacted at 120° C. for 3.5 hours, at 135° C. for 20 hours, and at 150° C. for 5 hours. To the resultant oligomer dope were added terephthalic acid (5.6 g) and a dispersion of bisbenzimidazo[2,1-b:2',1'-i]benzo[1mn][3,8]-phenathroline-8,17-dione (19.2 g) in 116% polyphosphoric acid (74.4 g). The mixture was reacted at 170° for 5 hours and at 200° C. for 10 hours. The resultant polymer dope of polyparaphenylenebenzobisoxazole had an intrinsic viscosity of 28 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 13

Under a stream of a nitrogen gas, 2,4-diamino-resorcinol hydrochloride (334.5 g) and terephthalic acid (252.7 g) were added to 122% polyphosphoric acid (2,165.5 g), and the mixture was stirred at 60° C. for 30 minutes. Then, the temperature was gradually increased, so that the mixture was reacted at 120° C. for 3.5 hours, at 135° C. for 20 hours, and at 150° C. for 5 hours. To the resultant oligomer dope were added a dispersion of terephthalic acid (5.6 g) in 116% polyphosphoric acid (74.4 g) and a dispersion of 3,3'-[(2-methyl-1,3-phenylene)diimino]bis[4,5,6,7-tetrachloro-1H-isoindole-1-one] (19.2 g) in 116% polyphosphoric acid (76.8 g). The mixture was reacted at 170° for 5 hours and at 200° C. for 10 hours. The resultant polymer dope of polyparaphenylenebenzobisoxazole had an intrinsic viscosity of 27 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 14

Under a stream of a nitrogen gas, 2,4-diamino-resorcinol hydrochloride (334.5 g), terephthalic acid (260.8 g), 8,16-pyranthrene dione (19.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours, and at 170° C. for 20 hours. The resultant polymer dope of polyparaphenylenebenzobisoxazole had an intrinsic viscosity of 26 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 15

Under a stream of a nitrogen gas, 2,5-diamino-1,4-benzenethiol dihydrochloride (384.9 g) and terephthalic acid (252.7 g) were added to 122% polyphosphoric acid (2,165.5 g), and the mixture was stirred at 60° C. for 30 minutes. Then, the temperature was gradually increased, so that the mixture was reacted at 120° C. for 3.5 hours, at 135° C. for 20 hours, and at 150° C. for 5 hours. To the resultant oligomer dope were added terephthalic acid (5.6 g) and a dispersion of 29H,31H-phthalocyaninate(2-)-N29, N30, N31,N32 copper (22.0 g) in 116% polyphosphoric acid (74.4 g). The mixture was reacted at 170° for 5 hours and at 200° C. for 5 hours. The resultant polymer dope of polyparaphenylenebenzobisthiazole had an intrinsic viscosity of 26 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 16

Under a stream of a nitrogen gas, 3-amino-4-hydroxybenzoic acid (300.0 g) and 29H,31H-phthalocyaninate(2-)-N29,N30,N31,N32 copper (12.1 g) were added to polyphosphoric acid prepared from 116% polyphosphoric acid (787.0 g) and diphosphorus pentaoxide (263 g), and the mixture was stirred at 60° C. for 30 minutes. Then, the temperature was gradually increased, so that the mixture was reacted at 120° C. for 3.5 hours, at 135° C. for 20 hours, at 150° C. for 5 hours, at 170° C. for 5 hours and at 200° C. for 5 hours. The resultant polymer dope of polybenzoxazole had an intrinsic viscosity of 12 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 17

Under a stream of a nitrogen gas, 3-amino-4-hydroxybenzoic acid (300.0 g) and phthalocyanine green (12.1 g) were added to polyphosphoric acid prepared from 116% polyphosphoric acid (787.0 g) and diphosphorus pentaoxide (263 g), and the mixture was stirred at 60° C. for 30 minutes. Then, the temperature was gradually increased, so that the mixture was reacted at 120° C. for 3.5 hours, at 135° C. for 20 hours, at 150° C. for 5 hours, at 170° C. for 5' hours and at 200° C. for 5 hours. The resultant polymer dope of polybenzoxazole had an intrinsic viscosity of 11 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 18

Under a stream of a nitrogen gas, 3-amino-4-hydroxybenzoic acid (300.0 g) and bisbenzimidazo[2,1-b:2',1'-i]benzo[1mn][3,8]phenanthroline-8,17-dione (12.1 g) were added to polyphosphoric acid prepared from 116% polyphosphoric acid (787.0 g) and diphosphorus pentaoxide (263 g), and the mixture was stirred at 60° C. for 30 minutes. Then, the temperature was gradually increased, so that the mixture was reacted at 120° C. for 3.5 hours, at 135° C. for 20 hours, at 150° C. for 5 hours, at 170° C. for 5 hours and at 200° C. for 5 hours. The resultant polymer dope of polybenzoxazole had an intrinsic viscosity of 10 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

EXAMPLE 19

Under a stream of a nitrogen gas, 3,4-diaminobenzoic dihydrochloride (440.9 g) and bisbenzimidazo[2,1-b:2',1'-i]benzo[1mn][3,8]phenanthroline-8,17-dione (8.1 g) were added to polyphosphoric acid prepared from 116% polyphosphoric acid (787.0 g) and diphosphorus pentaoxide (263 g), and the mixture was stirred at 60° C. for 30 minutes. Then, the temperature was gradually increased, so that the mixture was reacted at 120° C. for 3.5 hours, at 135° C. for 20 hours, at 150° C. for 5 hours, at 170° C. for 5 hours and at 200° C. for 5 hours. The resultant polymer dope of polybenzoimidazole had an intrinsic viscosity of 9 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

COMPARATIVE EXAMPLE 1

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant dope of poly(p-phenylenebenzobisoxazole) had an intrinsic viscosity of 30 dL/g at 30° C., which was measured by using a methanesulfonic acid solution. This dope (2.0 kg) was spun in the same manner as described above. The results of the storage test at high temperature and high humidity (80° C. and 80 RH %) and the light exposure test of the resultant filaments are shown in Table 1.

COMPARATIVE EXAMPLE 2

Under a stream of a nitrogen gas, 4,6-diaminoresorcinol dihydrochloride (334.5 g), terephthalic acid (260.8 g), safranine (19.4 g) and 122% polyphosphoric acid (2,078.2 g) were stirred at 60° C. for 30 minutes. Then, the temperature was gradually increased, so that the mixture was, reacted at 135° C. for 20 hours, at 150° C. for 5 hours and at 170° C. for 20 hours. As a result, a black rubber-like mass from which filaments could not be drawn was obtained. Spinning from this product was impossible.

COMPARATIVE EXAMPLE 3

Under a stream of a nitrogen gas, 4,6-diaminoresorcinol dihydrochloride (334.5 g), terephthalic acid (260.8 g), aniline black (19.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. As a result, a black rubber-like mass from which filaments could not be drawn was obtained. Spinning from this product was impossible.

COMPARATIVE EXAMPLE 4

Under a stream of a nitrogen gas, 4,6-diaminoresorcinol dihydrochloride (334.5 g), terephthalic acid (260.8 g), bisbenzimidazo[2,1-b:2',1'-i]benzo[1mn][3,8]phenathroline-8,17-dione (50.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant dope of polyparaphenylenebenzobisoxazole had an intrinsic viscosity of 26 dL/g at 30° C., which was measured by using a methanesulfonic acid solution. Spinning was carried out using this dope in the same manner as described above. The filaments were frequently broken just under the spinning nozzle, and thus, the spinning from this dope was impossible.

COMPARATIVE EXAMPLE 5

Under a stream of a nitrogen gas, 4,6-diaminoresorcinol dihydrochloride (334.5 g), terephthalic acid (260.8 g), bisbenzimidazo[2,1-b:2',1'-i]benzo[1mn][3,8]phenathroline-8,17-dione (3.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of polyparaphenylenebenzobisoxazole had an intrinsic viscosity of 26 dL/g at 30° C., which was measured by using a methanesulfonic acid solution. This dope was spun in the same manner as described above. The results of the storage test at high temperature and high humidity (80° C. and 80 RH %) and the light exposure test of the resultant filaments are shown in Table 1.

As is apparent from the results shown in Table 1, it is known that the polybenzazole fibers or filaments of Examples showed very high strength retentions after exposed to atmospheres of high temperatures and high humidity and xenon irradiation, as compared with the fibers or filaments of Comparative Examples.

EXAMPLE 20

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. To this dope (2.0 kg) was added 29H,31H-phthalocyaninate (2-)-N29,N30,N31,N32 copper (15.2 g), and the mixture was stirred. After that, the solution was spun in the same manner as described above. The resultant filaments were combined to make a tow having a fineness of 30,000 denier. The tow was crimped with a push-on crimper having rolls with width of 20 mm. The crimped tow was cut into staple fibers with given lengths of 44 mm, using a rotary cutter. The staple fibers were subjected to a storage test under an atmosphere of high temperature and high humidity (80° C. and 80 RH %) and a light exposure test. The results are shown in Table 2.

EXAMPLE 21

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 29 dL/g at 30° C., which was measured by using a methanesulfonic acid solution. To this dope (2.0 kg) was added bisbenzimidazo[2,1-b:2',1'-i]benzo[1mn][3,8]-phenanthroline-8,17-dione (15.2 g), and the mixture was stirred. After that, the solution was spun in the same manner as described above. The resultant filaments were combined to make a tow having a fineness of 30,000 denier. The tow was crimped with a push-on crimper having rolls with width of 20 mm. The crimped tow was cut into staple fibers with given lengths of 44 mm, using a rotary cutter. The staple fibers were subjected to a storage test under an atmosphere of high temperature and high humidity (80° C. and 80 RH %) and a light exposure test. The results are shown in Table 2.

EXAMPLE 22

Under a stream of a nitrogen gas, 4,6-diaminoresorcinol dihydrochloride (334.5 g), terephthalic acid (260.8 g) and 122% polyphosphoric acid (2,078.2 g) were stirred at 60° C.

for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 29 dL/g at 30° C., which was measured by using a methanesulfonic acid solution. To this dope (2.0 kg) was added 9,19-dichloro-5,15-diethyl-5,15-dihydrodiindolo[2,3-c:2',3'-n]triphenodioxazine (15.2 g), and the mixture was stirred. After that, the solution was spun in the same manner as described above. The resultant filaments were combined to make a tow having a fineness of 30,000 denier. The tow was crimped with a push-on crimper having rolls with width of 20 mm. The crimped tow was cut into staple fibers with given lengths of 44 mm, using a rotary cutter. The staple fibers were subjected to a storage test under an atmosphere of high temperature and high humidity (80° C. and 80 RH %) and a light exposure test. The results are shown in Table 2.

EXAMPLE 23

Under a stream of a nitrogen gas, 4,6-diaminoresorcinol dihydrochloride (334.5 g), terephthalic acid (260.8 g), 5,12-dihydro-2,9-dimethylguino[2,3-b]acridine-7,14-dione (19.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of polyparaphenylenebenzobisoxazole had an intrinsic viscosity of 24 dL/g at 30° C., which was measured by using a methanesulfonic acid solution. This dope was spun in the same manner as described above. The resultant filaments were combined to make a tow having a fineness of 30,000 denier. The tow was crimped with a push-on crimper having rolls with width of 20 mm. The crimped tow was cut into staple fibers with given lengths of 44 mm, using a rotary cutter. The staple fibers were subjected to a storage test under an atmosphere of high temperature and high humidity (80° C. and 80 RH %) and a light exposure test. The results are shown in Table 2.

EXAMPLE 24

Under a stream of a nitrogen gas, 4,6-diaminoresorcinol dihydrochloride (334.5 g) and terephthalic acid (252.7 g) were added to 122% polyphosphoric acid (2,165.5 g), and the mixture was stirred at 60° C. for 30 minutes. Then, the temperature was gradually increased, so that the mixture was reacted at 120° C. for 3.5 hours, at 135° C. for 20 hours and at 150° C. for 5 hours. To the resultant oligomer dope were added terephthalic acid (5.6 g) and a dispersion of 29H,31H-phthalocyaninate(2-)-N29,N30,N31,N32 copper (19.2 g) in 116% polyphosphoric acid (74.4 g), and the mixture was reacted at 170° C. for 5 hours and at 200° C. for 10 hours. The resultant polymer dope of polyparaphenylenebenzobisoxazole had an intrinsic viscosity of 26 dL/g at 30° C., which was measured by using a methanesulfonic acid solution. This dope was spun in the same manner as described above. The resultant filaments were combined to make a tow having a fineness of 30,000 denier. The tow was crimped with a push-on crimper having rolls with width of 20 mm. The crimped tow was cut into staple fibers with given lengths of 44 mm, using a rotary cutter. The staple fibers were subjected to a storage test under an atmosphere of high temperature and high humidity (80° C. and 80 RH %) and a light exposure test. The results are shown in Table 2.

COMPARATIVE EXAMPLE 6

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. This dope (2.0 kg) was spun in the same manner as described above. The resultant filaments were combined to make a tow having a fineness of 30,000 denier. The tow was crimped with a push-on crimper having rolls with width of 20 mm. The crimped tow was cut into staple fibers with given lengths of 44 mm, using a rotary cutter. The staple fibers were subjected to a storage test under an atmosphere of high temperature and high humidity (80° C. and 80 RH %) and a light exposure test. The results are shown in Table 2.

As is apparent from the results shown in Table 2, it is known that the polybenzazole staple fibers of Examples had very high strength retentions after exposed to atmospheres of high temperatures and high humidity and light irradiation, as compared with the staple fibers of Comparative Example.

EXAMPLE 25

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. To this dope (2.0 kg) was added 29H,31H-phthalocyaninate (2-)-N29,N30,N31,N32 copper (15.2 g), and the mixture was stirred. After that, the solution was spun in the same manner as described above. The resultant polybenzazole filaments were cut into staple fibers with lengths of 51 mm. The staple fibers were twisted at a twist constant of 3.5 to make a spun yarn with a cotton yarn count of 20Ne. The tensile strength of the resultant spun yarn was 9.5 cN/dtex. The spun yarn showed a strength retention of 74% after subjected to a storage test under an atmosphere of high temperature and high humidity (80° C. and 80 RH %), and showed a strength retention of 41% after subjected to a light exposure test.

COMPARATIVE EXAMPLE 7

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. This dope (2.0 kg) was spun in the same manner as described above. The resultant polybenzazole filaments were cut into staple fibers with lengths of 51 mm. The staple fibers were twisted at a twist constant of 3.5 to make a spun yarn with a cotton yarn count of 20Ne. The tensile strength of the resultant spun yarn was 9.3 cN/dtex. The spun yarn showed a strength retention of 63% after subjected to a storage test under an atmosphere of high temperature and high humidity (80° C. and 80 RH %), and showed a strength retention of 19% after subjected to a light exposure test.

As is apparent from the above results, it is known that the spun yarn made of the polybenzazole staple fibers of Example 25 had a very high strength retention after exposed to an atmosphere of high temperature and high humidity and light irradiation, as compared with the spun yarn made of the staple fibers of Comparative Example 7.

EXAMPLE 26

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. To this dope (2.0 kg) was added 29H,31H-phthalocyaninate (2-)-N29,N30,N31,N32 copper (15.2 g), and the mixture was stirred. After that, the solution was spun in the same manner as described above. The resultant filaments were subjected to a storage test under an atmosphere of high temperature and high humidity (80° C. and 80 RH %) and a light exposure test. The results are shown in Table 3.

The filaments were combined to make a tow having a fineness of 30,000 denier. The tow was crimped with a push-on crimper having rolls with width of 20 mm. The crimped tow was cut into staple fibers with given lengths of 44 mm, using a rotary cutter. The resultant staple fibers were opened with an opener, and a web with a weight of 200 g/m$^2$ was made of the opened staple fibers, using a roller card. A plurality of such webs were laminated and subjected to needle punching to make felt with a thickness of 10.0 mm and a weight of 2,600 g/m$^2$. The abrasion resistance of the felt at a high temperature was evaluated. As a result, the decrease in the weight of the felt due to the abrasion was 3.1 mg/cm$^2$.

EXAMPLE 27

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 29 dL/g at 30° C., which was measured by using a methanesulfonic acid solution. To this dope (2.0 kg) was added bisbenzimidazo[2,1-b:2',1'-i]benzo[1mn][3,8]phenanthroline-8,17-dione (15.2 g), and the mixture was stirred. After that, the solution was spun in the same manner as described above. The resultant filaments were subjected to a storage test under an atmosphere of high temperature and high humidity (80° C. and 80 RH %) and a light exposure test. The results are shown in Table 3.

The filaments were finished in the same manner as in Example 26 to make felt with a thickness of 10.0 mm and a weight of 2,500 g/m$^2$. The abrasion resistance of the felt at a high temperature was evaluated. As a result, the decrease in the weight of the felt due to the abrasion was 3.3 mg/cm$^2$.

EXAMPLE 28

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 29 dL/g at 30° C., which was measured by using a methanesulfonic acid solution. To this dope (2.0 kg) was added 9,19-dichloro-5,15-diethyl-5,15-dihydrodiindolo[2,3-c:2',3'-n]triphenodioxazine (15.2 g), and the mixture was stirred. After that, the solution was spun in the same manner as described above. The resultant filaments were subjected to a storage test under an atmosphere of high temperature and high humidity (80° C. and 80 RH %) and a light exposure test. The results are shown in Table 3.

The filaments were finished in the same manner as in Example 26 to make felt with a thickness of 9.9 mm and a weight of 2,500 g/m$^2$. The abrasion resistance of the felt at a high temperature was evaluated. As a result, the decrease in the weight of the felt due to the abrasion was 3.4 mg/cm$^2$.

EXAMPLE 29

Under a stream of a nitrogen gas, 4,6-diaminoresorcinol dihydrochloride (334.5 g), terephthalic acid (260.8 g), 5,12-dihydro-2,9-dimethylquino[2,3-b]acridine-7,14-dione (19.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of polyparaphenylenebenzobisoxazole had an intrinsic viscosity of 24 dL/g at 30° C., which was measured by using a methanesulfonic acid solution. This polymer dope was spun in the same manner as described above. The resultant filaments were subjected to a storage test under an atmosphere of high temperature and high humidity (80° C. and 80 RH %) and a light exposure test. The results are shown in Table 3.

The filaments were finished in the same manner as in Example 26 to make felt with a thickness of 10.3 mm and a weight of 2,700 g/m$^2$. The abrasion resistance of the felt at a high temperature was evaluated. As a result, the decrease in the weight of the felt due to the abrasion was 3.4 mg/cm$^2$.

EXAMPLE 30

Under a stream of a nitrogen gas, 4,6-diaminoresorcinol dihydrochloride (334.5 g) and terephthalic acid (252.7 g) were added to 122% polyphosphoric acid (2,165.5 g), and the mixture was stirred at 60° C. for 30 minutes. Then, the temperature was gradually increased, so that the mixture was reacted at 120° C. for 3.5 hours, at 135° C. for 20 hours and at 150° C. for 5 hours. To the resultant oligomer dope were added terephthalic acid (5.6 g) and a dispersion of 29H,31H-phthalochaninate(2-)-N29,N30,N31,N32 copper (19.2 g) in 116% polyphosphoric acid (74.4 g). Then, the mixture was reacted at 170° C. for 5 hours and at 200° C. for 10 hours. The resultant polymer dope of polyparaphenylenebenzobisoxazole had an intrinsic viscosity of 26 dL/g at 30° C., which was measured by using a methanesulfonic acid solution. This polymer dope was spun in the same manner as described above. The resultant filaments were subjected to a storage test under an atmosphere of high temperature and high humidity (80° C. and 80 RH %) and a light exposure test. The results are shown in Table 3.

The filaments were finished in the same manner as in Example 26 to make felt with a thickness of 10.1 mm and a weight of 2,600 g/m$^2$. The abrasion resistance of the felt at a high temperature was evaluated. As a result, the decrease in the weight of the felt due to the abrasion was 3.2 mg/cm$^2$.

COMPARATIVE EXAMPLE 8

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. This polymer dope (2.0 kg) was spun in the same manner as described above. The resultant filaments were subjected to a storage test under an atmosphere of high temperature and high humidity (80° C. and 80 RH %) and a light exposure test. The results are shown in Table 3.

The filaments were finished in the same manner as in Example 26 to make felt with a thickness of 9.8 mm and a weight of 2,500 g/m$^2$. The abrasion resistance of the felt at a high temperature was evaluated. As a result, the decrease in the weight of the felt due to the abrasion was 4.0 mg/cm$^2$.

As is apparent from the results of Table 3, it is known that the felt materials made of the polybenzazole fibers of Examples are very excellent in abrasion resistance under atmospheres of high temperatures an high humidity, as compared with the felt material of Comparative Example.

According to the present invention, it is possible to provide felt materials made of the polybenzazole fibers capable of sufficiently maintaining the strength even when exposed to atmospheres of high temperatures and high humidity over long periods of time. Therefore, the felt materials of the present invention can be effectively used to convey hot products which retain heat of, particularly 300° C. or higher, especially 400° C. or higher, manufactured in the field of molding metals such as aluminum, iron, copper, etc. and ceramics, although the applications of the felt materials and the temperature range are not limited to those.

EXAMPLE 31

Under a stream of a nitrogen gas, 4,6-diaminoresorcinol dihydrochloride (334.5 g), terephthalic acid (26.0.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. To this polymer dope (2.0 kg) was added 29H,31H-phthalocyaninate(2-)-N29,N30,N31,N32 copper (15.2 g), and the mixture was stirred. The resultant solution was spun in the same manner as described above. The resultant polybenzazole filaments were cut into staple fibers with lengths of 51 mm, which were then twisted at a twist constant of 3.5 to make a yarn with a cotton yarn count of 20/1Ne. Two such yarns were twisted to make a two folded yarn with a cotton yarn count of 20/2Ne. Such two folded yarns are woven to make a 2/1 twill fabric which was filled with 68 warp yarns/inch and 60 weft yarns/inch. The tensile strength of the resultant fabric in the vertical direction was 4,150 N/3 cm. The fabric was subjected to a storage test under an atmosphere of high temperature and high humidity (80° C. and 80 RH %). As a result, the strength retention of the fabric was 81%. The fabric was further subjected to a light exposure test. As a result, the strength retention thereof was 38%.

EXAMPLE 32

The yarns with a cotton yarn count of 20/1 Ne made in Example 31 were used to make a tubular knitted fabric which was filled with 68 stitches/inch in the vertical direction and 29 stitches/inch in the lateral direction. The tensile strength of the resultant fabric in the vertical direction was 1,650 N/5 cm. The fabric was subjected to a storage test under an atmosphere of high temperature and high humidity (80° C. and 80 RH %). As a result, the strength retention of the fabric was 75%. The fabric was further subjected to a light exposure test. As a result, the strength retention thereof was 44%.

COMPARATIVE EXAMPLE 9

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. This polymer dope (2.0 kg) was spun in the same manner as described above. The resultant polybenzazole filaments were cut into staple fibers with lengths of 51 mm, which were then twisted at a twist constant of 3.5 to make a yarn with a cotton yarn count of 20/1Ne. Two such yarns were twisted to make a two folded yarn with a cotton yarn count of 20/2Ne. Such two folded yarns are woven to make a 2/1 twill fabric which was filled with 68 warp yarns/inch and 60 weft yarns/inch. The tensile strength of the resultant fabric in the vertical direction was 4,320 N/3 cm. The fabric was subjected to a storage test under an atmosphere of high temperature and high humidity (80° C. and 80 RH %). As a result, the strength retention of the fabric was 62%. The fabric was further subjected to a light exposure test. As a result, the strength retention thereof was 21%.

COMPARATIVE EXAMPLE 10

The yarns with a cotton yarn count of 20/1Ne made in Comparative Example 9 were used to make a tubular knitted fabric which was filled with 68 stitches/inch in the vertical direction and 29 stitches/inch in the lateral direction. The tensile strength of the resultant fabric in the vertical direction was 1,580 N/5 cm. The fabric was subjected to a storage test under an atmosphere of high temperature and high humidity (80° C. and 80 RH %). As a result, the strength retention of the fabric was 59%. The fabric was further subjected to a light exposure test. As a result, the strength retention thereof was 18%.

It is known from the above results that the woven fabric and the knitted fabric made of the polybenzazole fibers of Examples 31 and 32 are very high in strength retention after exposed to atmospheres of high temperatures and high humidity and light irradiation, as compared with the woven fabric and the knitted fabric made of Comparative Examples 9 and 10.

EXAMPLE 33

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. To this polymer dope (2.0 kg) was added 29H,31H-phthalocyaninate(2-)-N29,N30,N31,N32 copper (15.2 g), and the mixture was stirred.

After that, the resultant solution was spun to make filaments with diameters of 11.5 μm and fineness of 1.5 denier. The filaments were extruded from a nozzle which had 166 holes with diameters of 180 μm at a spinning temperature of 175° C., and pushed into a first washing bath which was disposed so that the pushed filaments could be converged at an appropriate position to make a multifilament. A quench chamber was located in air gap between the nozzle and the first washing bath, so that the filaments could be elongated at an uniform temperature. The length of the air gap was 30 cm. The filaments were extruded in an air at 60° C. The takeup rate was 200 m/min., and the spinning elongation multiplying factor was 30. The filaments were washed with water until the concentration of the residual phosphorus in the polybenzazole filaments reached 6,000 ppm or less. The filaments were neutralized with a 1% NaOH aqueous solution for 10 seconds and washed with water for 30 seconds, and dried at 200° C. for 3 minutes. Then, the filaments were wound onto bobbins.

Six polybenzazole filaments thus obtained were Z-wise twisted at 32T/10 cm to make a Z twist yarn. Two such Z twist yarns were S-wise twisted at 32T/10 cm to make a crude cord. Then, the crude cord was subjected to a two-stage dipping treatment to make a dip cord. The first dipping treatment was carried out at 240° C., using an aqueous dispersion of an epoxy resin, and the second dipping treatment was carried out at 235° C., using a RFL liquid. The strength of the dip cord was 655 N. This dip cord was excellent in strength retention of as high as 76% under an atmosphere of high temperature and high humidity.

COMPARATIVE EXAMPLE 11

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. This polymer dope (2.0 kg) was spun in the same manner as described above.

Six polybenzazole filaments thus obtained were Z-wise twisted at 32T/10 cm to make a Z twist yarn. Two such Z twist yarns were S-wise twisted at 32T/10 cm to make a crude cord. Then, the crude cord was subjected to a two-stage dipping treatment to make a dip cord. The first dipping treatment was carried out at 240° C., using an aqueous dispersion of an epoxy resin, and the second dipping treatment was carried out at 235° C., using a RFL liquid. The strength of the dip cord was 662 N. This dip cord was inferior in strength retention of as low as 59% under an atmosphere of high temperature and high humidity, as compared with the dip cord of Example 33.

EXAMPLE 34

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. To this polymer dope (2.0 kg) was added 29H,31H-phthalocyaninate(2-)-N29,N30,N31,N32 copper (15.2 g), and the mixture was stirred.

After that, the resultant solution was spun to make filaments with diameters of 11.5 μm and fineness of 1.5 denier. The filaments were extruded from a nozzle which had 166 holes with diameters of 180 μm at a spinning temperature of 175° C., and pushed into a first washing bath which was disposed so that the pushed filaments could be converged at an appropriate position to make a multifilament. A quench chamber was located in air gap between the nozzle and the first washing bath, so that the filaments could be elongated at an uniform temperature. The length of the air gap was 30 cm. The filaments were extruded in an air at 60° C. The takeup rate was 200 m/min., and the spinning elongation multiplying factor was 30. The filaments were washed with water until the concentration of the residual phosphorus in the polybenzazole filaments reached 6,000 ppm or less. The filaments were neutralized with a 1% NaOH aqueous solution for 10 seconds and washed with water for 30 seconds, and dried at 200° C. for 3 minutes. Then, the filaments were wound onto bobbins.

Twelve polybenzazole filaments thus obtained were twisted at 20T/1 m to make a doubled twist yarn having a fineness of 3,000 denier. The doubled twist yarns were woven with a rapier loom to make a plain weave fabric which was filled with 17 warp yarns/inch and 17 weft yarns/inch. The weight of the fabric was 485 g/m$^2$. The tensile strength of the fabric in the warp direction was 620 kg/cm. The decrease in the strength of the fabric under an atmosphere of high temperature and high humidity, and the decrease in strength of the fabric which had been subjected to a light resistance test were measured. As a result, the strength retentions thereof were as high as 82% and 65%, respectively.

COMPARATIVE EXAMPLE 12

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. This polymer dope (2.0 kg) was spun in the same manner as described above.

Twelve polybenzazole filaments thus obtained were twisted at 20T/1 m to make a doubled twist yarn having a fineness of 3,000 denier. The doubled twist yarns were woven with a rapier loom to make a plain weave fabric which was filled with 17 warp yarns/inch and 17 weft yarns/inch. The weight of the fabric was 490 g/m$^2$. The tensile strength of the fabric in the warp direction was 637 kg/cm. The decrease in the strength of the fabric under an atmosphere of high temperature and high humidity, and the decrease in strength of the fabric which had been subjected to a light resistance test were measured. As a result, the strength retentions thereof were 65% and 48%, respectively, which were inferior to those of the fabric of Example 34.

EXAMPLE 35

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. To this polymer dope (2.0 kg) was added 29H,31H-phthalocyaninate(2-)-N29,N30,N31,N32 copper (15.2 g), and the mixture was stirred.

After that, the resultant solution was spun to make filaments with diameters of 11.5 μm and fineness of 1.5 denier. The filaments were extruded from a nozzle which had 166 holes with diameters of 180 μm at a spinning temperature of 175° C., and pushed into a first washing bath which was disposed so that the pushed filaments could be converged at an appropriate position to make a multifilament. A quench chamber was located in air gap between the nozzle and the first washing bath, so that the filaments could be elongated at an uniform temperature. The length of the air gap was 30 cm. The filaments were extruded in an air at 60° C. The takeup rate was 200 m/min., and the spinning elongation multiplying factor was 30. The filaments were washed with water until the concentration of the residual phosphorus in the polybenzazole filaments reached 6,000 ppm or less. The filaments were neutralized with a 1% NaOH aqueous solution for 10 seconds and washed with water for 30 seconds, and dried at 200° C. for 3 minutes. Then, the filaments were wound onto bobbins.

Twelve polybenzazole filaments thus obtained were twisted at 20T/1 m to make a doubled twist yarn having a fineness of 3,000 denier. Sixteen doubled twist yarns were braided to make a braid. The braid was impregnated with an epoxy resin and set hard, to thereby provide a rod with a diameter of 2 mm, containing 16% of the resin. The decrease in the strength of the rod under an atmosphere of high temperature and high humidity was measured. As a result, the strength retention of the rod was as high as 86%.

COMPARATIVE EXAMPLE 13

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. This polymer dope (2.0 kg) was spun in the same manner as described above.

Twelve polybenzazole filaments thus obtained were twisted at 20T/1 m to make a doubled twist yarn having a fineness of 3,000 denier. Sixteen doubled twist yarns were braided to make a braid. The braid was impregnated with an epoxy resin and set hard, to thereby provide a rod with a diameter of 2 mm, containing 16% of the resin. The decrease in the strength of the rod under an atmosphere of high temperature and high humidity was measured. As a result, the strength retention of the rod was 72% which was inferior to that of the rod of Example 35.

EXAMPLE 36

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. To this polymer dope (2.0 kg) was added 29H,31H-phthalocyaninate(2-)-N29,N30,N31,N32 copper (15.2 g), and the mixture was stirred.

After that, the resultant solution was spun to make filaments with diameters of 11.5 μm and fineness of 1.5 denier. The filaments were extruded from a nozzle which had 166 holes with diameters of 180 μm at a spinning temperature of 175° C., and pushed into a first washing bath which was disposed so that the pushed filaments could be converged at an appropriate position to make a multifilament. A quench chamber was located in air gap between the nozzle and the first washing bath, so that the filaments could be elongated at an uniform temperature. The length of the air gap was 30 cm. The filaments were extruded in an air at 60° C. The takeup rate was 200 m/min., and the spinning elongation multiplying factor was 30. The filaments were washed with water until the concentration of the residual phosphorus in the polybenzazole filaments reached 6,000 ppm or less. The filaments were neutralized with a 1% NaOH aqueous solution for 10 seconds and washed with water for 30 seconds, and dried at 200° C. for 3 minutes. Then, the filaments were wound onto bobbins.

The durability of the filaments thus obtained was evaluated in the same manner as described above. As a result, the strength retention thereof was 83% in the light exposure test, and 90% in the storage test under an atmosphere of high temperature and high humidity.

COMPARATIVE EXAMPLE 14

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. This polymer dope (2.0 kg) was spun in the same manner as described above.

The durability of the filaments thus obtained was evaluated in the same manner as described above. As a result, the strength retention thereof was 75% in the light exposure test, and 37% in the storage test under an atmosphere of high temperature and high humidity, which were inferior to those of the filaments of Example 36.

EXAMPLE 37

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. To this polymer dope (2.0 kg) was added 29H,31H-phthalocyaninate(2-)-N29,N30,N31,N32 copper (15.2 g), and the mixture was stirred. After that, the resultant solution was spun in the same manner as described above.

The resultant polybenzazole filaments containing the pigment were doubled to make a yarn having a total denier of 1,500. Such yarns were used to make a scrim filled with 5 warp yarns/inch and 5 weft yarns/inch. This scrim was sandwiched between biaxially stretched polyester films with thickness of 12 microns to which a polyurethane adhesive was applied, and the resultant lamination was dried and set hard. Thus, a sail cloth weighing 320 g/m$^2$ was obtained. This sail cloth was cut to obtain a cloth strip with a width of 2.5 cm and a length of 50 cm which included five reinforcing filaments therein. This cloth strip was subjected to a storage test under an atmosphere of high temperature and high humidity and to a light exposure test. The results are shown in Table 4.

EXAMPLE 38

Bisbenzimidazo[2,1-b:2',1'-i]benzo[1mn][3,8]-phenathroline-8,17-dione (15.2 g) was added to a dope (2.0 kg) of poly(p-phenylenebenzobisoxazole) having an intrinsic viscosity of 29 dL/g prepared in the same manner as in Example 37, and the mixture was stirred. Then, the resultant solution was spun in the same manner as described above.

The resultant polybenzazole filaments containing the pigment were doubled to make a yarn having a total denier of 1,500. Such yarns were used to make a scrim filled with 5 warp yarns/inch and 5 weft yarns/inch. This scrim was sandwiched between biaxially stretched polyester films with thickness of 12 microns to which a polyurethane adhesive was applied, and the resultant lamination was dried and set hard. Thus, a sail cloth weighing 320 g/m$^2$ was obtained. This sail cloth was cut to obtain a cloth strip with a width of 2.5 cm and a length of 50 cm which included five reinforcing filaments therein. This cloth strip was subjected to a storage test under an atmosphere of high temperature and high humidity and to a light exposure test. The results are shown in Table 4.

EXAMPLE 39

9,19-Dichloro-5,15-diethyl-5,15-dihydrodiindlo[2,3-c:2',3'-n]triphenodioxazine (15.2 g) was added to a dope (2.0 kg) of poly(p-phenylenebenzobisoxazole) having an intrinsic viscosity of 29 dL/g prepared in the same manner as in Example 37, and the mixture was stirred. Then, the resultant solution was spun in the same manner as described above.

The resultant polybenzazole filaments containing the pigment were doubled to make a yarn having a total denier of 1,500. Such yarns were used to make a scrim filled with 5 warp yarns/inch and 5 weft yarns/inch. This scrim was sandwiched between biaxially stretched polyester films with thickness of 12 microns to which a polyurethane adhesive was applied, and the resultant lamination was dried and set hard. Thus, a sail cloth weighing 320 g/m$^2$ was obtained. This sail cloth was cut to obtain a cloth strip with a width of 2.5 cm and a length of 50 cm which included five reinforcing filaments therein. This cloth strip was subjected to a storage test under an atmosphere of high temperature and high humidity and to a light exposure test. The results are shown in Table 4.

EXAMPLE 40

Under a stream of a nitrogen gas, 4,6-diaminoresorcinol dihydrochloride (334.5 g), terephthalic acid (260.8 g), 5,12-dihydro-2,9-dimethylquino[2,3-b]acridine-7,14-dione (19.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of polyparaphenylenebenzobisoxazole had an intrinsic viscosity of 24 dL/g at 30° C., which was measured by using a methanesulfonic acid solution. This polymer dope was spun in the same manner as described above.

The resultant polybenzazole filaments containing the pigment were doubled to make a yarn having a total denier of 1,500. Such yarns were used to make a scrim filled with warp yarns/inch and 5 weft yarns/inch. This scrim was sandwiched between biaxially stretched polyester films with thickness of 12 microns to which a polyurethane adhesive was applied, and the resultant lamination was dried and set hard. Thus, a sail cloth weighing 320 g/m$^2$ was obtained. This sail cloth was cut to obtain a cloth strip with a width of 2.5 cm and a length of 50 cm which included five reinforcing filaments therein. This cloth strip was subjected to a storage test under an atmosphere of high temperature and high humidity and to a light exposure test. The results are shown in Table 4.

COMPARATIVE EXAMPLE 15

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. This polymer dope (2.0 kg) was spun in the same manner as described above.

The resultant polybenzazole filaments were doubled to make a yarn having a total denier of 1,500. Such yarns were used to make a scrim filled with 5 warp yarns/inch and 5 weft yarns/inch. This scrim was sandwiched between biaxially stretched polyester films with thickness of 12 microns to which a polyurethane adhesive was applied, and the resultant lamination was dried and set hard. Thus, a sail cloth weighing 320 g/m$^2$ was obtained. This sail cloth was cut to obtain a cloth strip with a width of 2.5 cm and a length of 50 cm which included five reinforcing filaments therein. This cloth strip was subjected to a storage test under an atmosphere of high temperature and high humidity and to a light exposure test. The results are shown in Table 4.

As is apparent from the results shown in Table 4, it is known that the sail cloths comprising the polybenzazole filaments of Example 37 to 40 are very high in strength retention after exposed to the atmospheres of high temperature and high humidity and to the light irradiation, as compared with the sail cloth of Comparative Example 15.

EXAMPLE 41

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. To this polymer dope (2.0 kg) was added 29H,31H-phthalocyaninate(2-)-N29,N30,N31,N32 copper (15.2 g), and the mixture was stirred. After that, the resultant solution was spun in the same manner as described above. The strength retention of the resultant polybenzazole filaments which had been subjected to a storage test under an atmosphere of high temperature and high humidity was 90%.

Twelve polybenzazole filaments thus obtained were twisted at 80T/m to make a doubled twist yarn with a thickness of 3,000 denier. Eight doubled twist yarns thus obtained were braided with a conventional braiding machine to make a rope. The strength retention of the rope which had been subjected to a storage test under an atmosphere of high temperature and high humidity was 81%, which was decreased by only 9%, as compared with the strength retention of the polybenzazole filaments used as the material. This rope was further subjected to a light exposure test. As a result, the strength retention of the rope which had been exposed to light for 100 hours was as high as 80%.

EXAMPLE 42

Bisbenzimidazo[2,1-b:2',1'-i]benzo[1mn][3,8]-phenanthroline-8,17-dione (15.2 g) was added to a dope (2.0 kg) of poly(p-phenylenebenzobisoxazole) having an intrinsic viscosity of 29 dL/g, prepared in the same manner as in Example 41, and the mixture was stirred. Then, the resultant solution was spun in the same manner as described above. The strength retention of the resultant filaments after subjected to a storage test under an atmosphere of high temperature and high humidity was 86%.

Twelve polybenzazole filaments thus obtained were twisted at 80T/m to make a doubled twist yarn with a thickness of 3,000 denier. Eight doubled twist yarns thus obtained were braided with a conventional braiding machine to make a rope. The strength retention of the rope which had been subjected to a storage test under an atmosphere of high temperature and high humidity was 76%, which was decreased by only 10%, as compared with the strength retention of the polybenzazole filaments used as the material.

EXAMPLE 43

9,19-Dichloro-5,15-diethyl-5,15-dihydrodiindlo[2,3-c:2',3'-n]triphenodioxazine (15.2 g) was added to a dope (2.0 kg) of poly(p-phenylenebenzobisoxazole) having an intrinsic viscosity of 29 dL/g, prepared in the same manner as in Example 41, and the mixture was stirred. Then, the resultant solution was spun in the same manner as described above. The strength retention of the resultant filaments after subjected to a storage test under an atmosphere of high temperature and high humidity was 85%.

Twelve polybenzazole filaments thus obtained were twisted at 80T/m to make a doubled twist yarn with a thickness of 3,000 denier. Eight doubled twist yarns thus obtained were braided with a conventional braiding machine to make a rope. The strength retention of the rope which had been subjected to a storage test under an atmosphere of high temperature and high humidity was 73%, which was decreased by only 12%, as compared with the strength retention of the polybenzazole filaments used as the material.

EXAMPLE 44

Under a stream of a nitrogen gas, 4,6-diaminoresorcinol dihydrochloride (334.5 g), terephthalic acid (260.8 g), 5,12-dihydro-2,9-dimethylquino[2,3,-b]acridine-7,14-dione (19.4 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of polyparaphenylenebenzobisoxazole had an intrinsic viscosity of 24 dL/g at 30° C., which was measured by using a methanesulfonic acid solution. This polymer dope was spun in the same manner as described above. The strength retention of the resultant polybenzazole filaments which had been subjected to a storage test under an atmosphere of high temperature and high humidity was 85%.

Twelve polybenzazole filaments thus obtained were twisted at 80T/m to make a doubled twist yarn with a thickness of 3,000 denier. Eight doubled twist yarns thus obtained were braided with a conventional braiding machine to make a rope. The strength retention of the rope which had been subjected to a storage test under an atmosphere of high temperature and high humidity was 76%, which was decreased by only 9%, as compared with the strength retention of the polybenzazole filaments used as the material.

COMPARATIVE EXAMPLE 16

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. This polymer dope (2.0 kg) was spun in the same manner as described above. The strength retention of the resultant polybenzazole filaments which had been subjected to a storage test under an atmosphere of high temperature and high humidity was 75%.

Twelve polybenzazole filaments thus obtained were twisted at 80T/m to make a doubled twist yarn with a thickness of 3,000 denier. Eight doubled twist yarns thus obtained were braided with a conventional braiding machine to make a rope. The strength retention of the rope which had been subjected to a storage test under an atmosphere of high temperature and high humidity was 50%, which was decreased by so large as 25%, as compared with the strength retention (75%) of the polybenzazole filaments used as the material. It was know from this fact that the durability of the filaments markedly decreased due to the damage in the course of the manufacturing of the rope. The rope was further subjected to a light exposure test for 100 hours. As a result, the strength retention of the rope was 58%, which was far lower than that of the rope of Example 41.

The results are summarized in Table 5. As is apparent from Table 5, it is known that the high strength fiber ropes comprising the polybenzazole filaments of Examples 41 to 44 have very high strength retentions after exposed to the atmospheres of high temperatures and high humidity, as compared with the rope of Comparative Example 16.

EXAMPLE 45

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. To this polymer dope (2.0 kg) was added 29H,31H-phthalocyaninate(2-)-N29,N30,N31,N32 copper (15.2 g), and the mixture was stirred.

After that, the resultant solution was spun to obtain filaments with diameters of 11.5 μm and fineness of 1.5 denier. The filaments were extruded from a nozzle which had 166 holes with diameters of 180 μm at a spinning temperature of 175° C., and pushed into a first washing bath which was disposed so that the pushed filaments could be converged at an appropriate position to make a multifilament. A quench chamber was located in an air gap between the nozzle and the first washing bath, so that the filaments could be elongated at an uniform temperature. The length of the air gap was 30 cm. The filaments were extruded in an air at 60° C. The takeup rate was 200 m/min., and the spinning elongation multiplying factor was 30. The filaments were washed with water until the concentration of the residual phosphorus in the polybenzazole filaments reached 6,000 ppm or less. The filaments were neutralized with a 1% NaOH aqueous solution for 10 seconds and washed with water for 30 seconds, and dried at 200° C. for 3 minutes. Then, the filaments were wound onto bobbins.

The resultant polybenzazole filament yarns were woven with a rapier loom to make a plain weave fabric filled with 30 warp yarns/25 mm and 30 weft yarns/25 mm. The weight of the fabric was 136 g/m$^2$. The tensile strength of the fabric in the warp direction was 2,670 N/3 cm. The decrease in the strength of the fabric under an atmosphere of high temperature and high humidity, and the decrease in the strength of the fabric which had been subjected to a light exposure test were measured. As a result, the strength retentions of the fabric were as high as 81% and as high as 64%, respectively.

COMPARATIVE EXAMPLE 17

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. This polymer dope (2.0 kg) was spun in the same manner as described above.

The resultant polybenzazole filament yarns were woven with a rapier loom to make a plain weave fabric filled with 60 warp yarns/25 mm and 60 weft yarns/25 mm. The weight of the fabric was 138 g/m$^2$. The tensile strength of the fabric in the warp direction was 2,810 N/3 cm. The decrease in the strength of the fabric under an atmosphere of high temperature and high humidity, and the decrease in the strength of the fabric which had been subjected to a light exposure test were measured. As a result, the strength retentions of the fabric were 63% and 47%, respectively, which were inferior to the results of the fabric of Example 45.

EXAMPLE 46

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. To this polymer dope (2.0 kg) was added 29H,31H-phthalocyaninate(2-)-N29,N30,N31,N32 copper (15.2 g), and the mixture was stirred.

After that, the resultant solution was spun to obtain filaments with diameters of 11.5 μm and fineness of 1.5 denier. The filaments were extruded from a nozzle which had 166 holes with diameters of 180 μm at a spinning temperature of 175° C., and pushed into a first washing bath which was disposed so that the pushed filaments could be converged at an appropriate position to make a multifilament. A quench chamber was located in an air gap between the nozzle and the first washing bath, so that the filaments could be elongated at an uniform temperature. The length of the air gap was 30 cm. The filaments were extruded in an air at 60° C. The takeup rate was 200 m/min., and the spinning elongation multiplying factor was 30. The filaments were washed with water until the concentration of the residual phosphorus in the polybenzazole filaments reached 6,000 ppm or less. The filaments were neutralized with a 1% NaOH aqueous solution for 10 seconds and washed with water for 30 seconds, and dried at 200° C. for 3 minutes. Then, the filaments were wound onto bobbins.

Two polybenzazole filaments thus obtained were doubled but not twisted, to make a yarn with a thickness of 555 dtex. The yarns thus obtained were woven with a rapier loom to make a plain weave fabric filled with 30 warp yarns/inch and 30 weft yarns/inch. The weight of the fabric was 135 g/m$^2$. The tensile strength of the fabric in the warp direction was 5,700 N/3 cm. The decrease in the strength of the fabric under an atmosphere of high temperature and high humidity, and the decrease in the strength of the fabric which had been subjected to a light exposure test were measured. As a result, the strength retentions of the fabric were as high as 81% and as high as 64%, respectively.

COMPARATIVE EXAMPLE 18

Under a stream of a nitrogen gas, 4,6-diaminoresorcinol dihydrochloride (334.5 g), terephthalic acid (260.8 g) and 122% polyphosphoric acid (2,078.2 g) were stirred at 60° C. for 30 minutes. Then, the temperature was gradually increased, so that the mixture was reacted at 135° C. for 20 hours, at 150° C. for 5 hours and at 170° C. for 20 hours. The resultant polymer dope of poly(p-phenylenebenzobisoxazole) had an intrinsic viscosity of 30 dL/g at 30° C., which was measured by using a methanesulfonic acid solution. This polymer dope (2.0 kg) was spun in the same manner as described above.

Two polybenzazole filaments thus obtained were doubled but not twisted, to make a yarn with a thickness of 555 dtex. The yarns thus obtained were woven with a rapier loom to make a plain weave fabric filled with 30 warp yarns/inch and 30 weft yarns/inch. The weight of the fabric was 133 g/m$^2$. The tensile strength of the fabric in the warp direction was 5,740 N/3 cm. The decrease in the strength of the fabric under an atmosphere of high temperature and high humidity, and the decrease in the strength of the fabric which had been subjected to a light exposure test were measured. As a result, the strength retentions of the fabric were 63% and 47%, respectively, which were inferior to the results of the fabric of Example 46.

TABLE 1

| | Concentration of phosphorus in filament ppm | Concentration of sodium in filament ppm | Na/P (Molar ratio) | Initial strength of filament GPa | After exposure to atmosphere of 80° C. and 80 RH % for 700 hours | | After exposure to light from xenon for 100 hours | |
|---|---|---|---|---|---|---|---|---|
| | | | | | Strength GPa | Retention % | Strength GPa | Retention % |
| Ex. 1 | 4010 | 2351 | 0.79 | 5.6 | 5.0 | 90 | 4.6 | 83 |
| Ex. 2 | 3603 | 2942 | 1.10 | 5.8 | 5.0 | 86 | 4.8 | 82 |
| Ex. 3 | 3503 | 2626 | 1.01 | 5.5 | 4.7 | 85 | 4.4 | 80 |
| Ex. 4 | 3524 | 3060 | 1.17 | 5.5 | 4.8 | 88 | 4.5 | 81 |
| Ex. 5 | 4283 | 2702 | 0.85 | 5.6 | 5.1 | 91 | 4.6 | 82 |
| Ex. 6 | 4365 | 2430 | 0.75 | 5.8 | 5.2 | 89 | 4.6 | 80 |
| Ex. 7 | 4523 | 3256 | 0.97 | 5.5 | 4.7 | 85 | 4.2 | 77 |
| Ex. 8 | 3289 | 2685 | 1.10 | 5.8 | 5.0 | 86 | 4.6 | 80 |
| Ex. 9 | 3343 | 2456 | 0.99 | 5.8 | 4.9 | 85 | 4.6 | 80 |
| Ex. 10 | 4400 | 3266 | 1.00 | 5.6 | 4.8 | 85 | 4.3 | 76 |
| Ex. 11 | 4114 | 2596 | 0.85 | 5.6 | 5.0 | 89 | 4.5 | 81 |
| Ex. 12 | 3488 | 2641 | 1.02 | 5.8 | 5.0 | 87 | 4.8 | 82 |
| Ex. 13 | 4154 | 3176 | 1.03 | 5.6 | 4.6 | 83 | 4.4 | 78 |
| Ex. 14 | 3276 | 2967 | 1.22 | 5.6 | 4.5 | 80 | 4.6 | 82 |
| Ex. 15 | 3246 | 2361 | 0.98 | 4.7 | 4.3 | 92 | 4.2 | 89 |
| Ex. 16 | 3155 | 2365 | 1.01 | 3.0 | 2.5 | 84 | 2.5 | 82 |
| Ex. 17 | 3339 | 2528 | 1.02 | 2.8 | 2.3 | 83 | 2.3 | 81 |
| Ex. 18 | 3684 | 3227 | 1.18 | 2.9 | 2.5 | 85 | 2.3 | 80 |
| Ex. 19 | 3903 | 2520 | 0.87 | 2.8 | 2.5 | 91 | 2.3 | 81 |
| C. Ex. 1 | 3402 | 3055 | 1.21 | 6.0 | 4.5 | 75 | 2.2 | 37 |
| C. Ex. 2 | — | — | — | — | — | — | — | — |
| C. Ex. 3 | — | — | — | — | — | — | — | — |
| C. Ex. 4 | — | — | — | — | — | — | — | — |
| C. Ex. 5 | 3285 | 2536 | 1.04 | 5.8 | 4.5 | 77 | 3.0 | 51 |

TABLE 2

| | Concentration of phosphorus in filament ppm | Concentration of sodium in filament ppm | Na/P (Molar ratio) | Initial strength of filament GPa | After exposure to atmosphere of 80° C. and 80 RH % for 700 hours | | After exposure to light from xenon for 100 hours | |
|---|---|---|---|---|---|---|---|---|
| | | | | | Strength GPa | Retention % | Strength GPa | Retention % |
| Ex. 20 | 4010 | 2351 | 0.79 | 5.6 | 5.0 | 90 | 4.6 | 83 |
| Ex. 21 | 3603 | 2942 | 1.10 | 5.8 | 5.0 | 86 | 4.8 | 82 |
| Ex. 22 | 3503 | 2626 | 1.01 | 5.5 | 4.7 | 85 | 4.4 | 80 |
| Ex. 23 | 4523 | 3256 | 0.97 | 5.5 | 4.7 | 85 | 4.2 | 77 |
| Ex. 24 | 4114 | 2596 | 0.85 | 5.6 | 5.0 | 89 | 4.5 | 81 |
| C. Ex. 6 | 3402 | 3055 | 1.21 | 6.0 | 4.5 | 75 | 2.2 | 37 |

TABLE 3

| | Concentration of phosphorus in filament ppm | Concentration of sodium in filament ppm | Na/P (Molar ratio) | Initial strength of filament GPa | After exposure to atmosphere of 80° C. and 80 RH % for 700 hours | | After exposure to light from xenon for 100 hours | | Abrasion resistance at high temperature (felt) |
|---|---|---|---|---|---|---|---|---|---|
| | | | | | Strength GPa | Retention % | Strength GPa | Retention % | Decrease in weight |
| Ex. 26 | 4010 | 2351 | 0.79 | 5.6 | 5.0 | 90 | 4.6 | 83 | 3.1 |
| Ex. 27 | 3603 | 2942 | 1.10 | 5.8 | 5.0 | 86 | 4.8 | 82 | 3.3 |
| Ex. 28 | 3503 | 2626 | 1.01 | 5.5 | 4.7 | 85 | 4.4 | 80 | 3.4 |
| Ex. 29 | 4523 | 3256 | 0.97 | 5.5 | 4.7 | 85 | 4.2 | 77 | 3.4 |
| Ex. 30 | 4114 | 2596 | 0.85 | 5.6 | 5.0 | 89 | 4.5 | 81 | 3.2 |
| C. Ex. 8 | 3402 | 3055 | 1.21 | 6.0 | 4.5 | 75 | 2.2 | 37 | 4.0 |

TABLE 4

| | Concentration of phosphorus in filament ppm | Concentration of sodium in filament ppm | Na/P (Molar ratio) | Exposure test under atmosphere of high temperature and high humidity | | | Light exposure test | | |
|---|---|---|---|---|---|---|---|---|---|
| | | | | Initial strength kgf/3 cm | Strength after treatment kgf/3 cm | Strength retention % | Initial strength kgf/3 cm | Strength after treatment kgf/3 cm | Strength retention % |
| Ex. 37 | 4010 | 2351 | 0.79 | 282 | 248.0 | 88 | 282 | 217 | 77 |
| Ex. 38 | 3603 | 2942 | 1.10 | 287 | 285.0 | 82 | 287 | 207 | 72 |
| Ex. 39 | 3503 | 2626 | 1.01 | 274 | 222.0 | 81 | 274 | 192 | 70 |
| Ex. 40 | 4523 | 3256 | 0.97 | 270 | 221.0 | 81 | 270 | 192 | 71 |
| C. Ex. 15 | 3402 | 3055 | 1.21 | 290 | 194.0 | 64 | 290 | 163 | 47 |

TABLE 5

| | Concentration of phosphorus in filament ppm | Concentration of sodium in filament ppm | Na/P (Molar ratio) | Properties of filament | | | Properties of rope | | |
|---|---|---|---|---|---|---|---|---|---|
| | | | | Initial strength GPa | Strength after treatment GPa | Strength retention % | Initial strength kgf | Strength after treatment kgf | Strength retention % |
| Ex. 41 | 4010 | 2351 | 0.79 | 5.6 | 5.0 | 90 | 634 | 514 | 81 |
| Ex. 42 | 3603 | 2942 | 1.10 | 5.8 | 5.0 | 86 | 627 | 477 | 76 |
| Ex. 43 | 3503 | 2626 | 1.01 | 5.5 | 4.7 | 85 | 610 | 445 | 73 |
| Ex. 44 | 4523 | 3256 | 0.97 | 5.5 | 4.7 | 85 | 603 | 458 | 76 |
| C. Ex. 16 | 3402 | 3055 | 1.21 | 6.0 | 4.5 | 75 | 648 | 324 | 50 |

INDUSTRIAL APPLICABILITY

According to the present invention, it is possible to provide polybenzazole fibers or filament having high durability under atmospheres of high temperatures and high humidity and light exposure, and thus, the applicable fields of such polybenzazole fibers or filaments become markedly wider, thereby contributing much to the industries.

The invention claimed is:

1. Polybenzazole fibers or filaments having a tensile strength retention of 85% or higher after exposed to an atmosphere of a temperature of 80° C. and a relative humidity of 80% for 700 hours.

2. Polybenzazole fibers or filaments according to claim 1, characterized in that the fibers or filaments have a strength retention of 50% or higher when exposed to light from a xenon lamp for 100 hours.

3. Polybenzazole fibers or filaments according to claim 1, characterized in that the fibers or filaments contain in themselves an organic pigment having heat resistance as high as a thermal decomposition temperature of 200° C. or higher, and soluble in a mineral acid.

4. Polybenzazole fibers or filaments according to claim 1, characterized in that the organic pigment contained in the fibers or filaments has group(s) of —N═ and/or NH— in the molecule.

5. Polybenzazole fibers or filaments according to claim 1, characterized in that the organic pigment contained in the fibers or filaments is any of perinones and/or perylenes.

6. Polybenzazole fibers or filaments according to claim 1, characterized in that the organic pigment contained in the fibers or filaments is any of phthalocyanines.

7. Polybenzazole fibers or filaments according to claim 1, characterized in that the organic pigment contained in the fibers or filaments is any of quinacridones.

8. Polybenzazole fibers or filaments according to claim 1, characterized in that the organic pigment contained in the fibers or filaments is any of dioxazines.

9. Polybenzazole staple fibers having a tensile strength retention of 85% or higher after exposed to an atmosphere of a temperature of 80° C. and a relative humidity of 80% for 700 hours.

10. A spun yarn comprising polybenzazole fibers or filaments as at least one component, the spun yarn having a tensile strength retention of 70% or higher after exposed to an atmosphere of a temperature of 80° C. and a relative humidity of 80% for 700 hours.

11. A cord for reinforcing rubber, comprising twisted yarns of polybenzazole fibers or filaments, the cord having a tensile strength retention of 70% or higher after exposed to an atmosphere of a temperature of 80° C. and a relative humidity of 80% for 700 hours.

12. A polybenzazole fiber sheet for reinforcing cement/concrete, having a tensile strength retention of 75% or higher after exposed to an atmosphere of a temperature of 80° C. and a relative humidity of 80% for 700 hours.

13. A polybenzazole fiber rod for reinforcing cement/concrete, having a tensile strength retention of 75% or higher after exposed to an atmosphere of a temperature of 80° C. and a relative humidity of 80% for 700 hours.

14. A composite material comprising polybenzazole fibers or filaments as at least one component, the composite material having a tensile strength retention of 75% or higher after exposed to an atmosphere of a temperature of 80° C. and a relative humidity of 80% for 700 hours.

15. A sail cloth excellent in durability, comprising polybenzazole fibers or filaments, the sail cloth having a tensile strength retention of 80% or higher in the fiber axial direction, after exposed to an atmosphere of a temperature of 80° C. and a relative humidity of 80% for 700 hours.

16. A high strength fiber rope comprising polybenzazole fibers or filaments, the fiber rope having a tensile strength retention of 85% or higher after exposed to an atmosphere of a temperature of 80° C. and a relative humidity of 80% for 700 hours.

17. A knife proof vest comprising polybenzazole fibers or filaments at least one component, the knife proof vest having a tensile strength retention of 75% or higher after exposed to an atmosphere of a temperature of 80° C. and a relative humidity of 80% for 700 hours.

18. A bullet proof vest comprising polybenzazole fibers or filaments at least one component, the bullet proof vest having a tensile strength retention of 75% or higher after exposed to an atmosphere of a temperature of 80° C. and a relative humidity of 80% for 700 hours.

* * * * *